US007897312B2

(12) United States Patent
Itami

(10) Patent No.: US 7,897,312 B2
(45) Date of Patent: Mar. 1, 2011

(54) IMAGE FORMING METHOD

(75) Inventor: Akihiko Itami, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 709 days.

(21) Appl. No.: 10/939,356

(22) Filed: Sep. 14, 2004

(65) Prior Publication Data

US 2005/0064309 A1 Mar. 24, 2005

(30) Foreign Application Priority Data

Sep. 18, 2003 (JP) ..... 2003-325884

(51) Int. Cl.
*G03G 5/147* (2006.01)

(52) U.S. Cl. ..... 430/60; 399/159

(58) Field of Classification Search ..... 430/60; 399/159

See application file for complete search history.

(56) References Cited

U.S. PATENT DOCUMENTS

| | | | | |
|---|---|---|---|---|
| 4,804,606 | A * | 2/1989 | Ohno et al. | 430/57.5 |
| 5,017,449 | A * | 5/1991 | Yoshihara | 430/58.4 |
| 6,074,791 | A * | 6/2000 | Jennings et al. | 430/58.8 |
| 6,322,940 | B1 | 11/2001 | Nishigaki et al. | |
| 6,544,703 | B2 * | 4/2003 | Hayata | 430/100 |
| 7,095,427 | B2 * | 8/2006 | Goto | 347/140 |
| 7,166,398 | B2 * | 1/2007 | Itami et al. | 430/60 |
| 2001/0019804 | A1 * | 9/2001 | Kurihara et al. | 430/60 |
| 2001/0049067 | A1 * | 12/2001 | Mitsumori et al. | 430/58.8 |
| 2002/0076631 | A1 * | 6/2002 | Itami et al. | 430/58.2 |
| 2002/0122999 | A1 * | 9/2002 | Hayata | 430/63 |
| 2002/0142239 | A1 * | 10/2002 | Sakimura et al. | 430/60 |
| 2003/0054274 | A1 * | 3/2003 | Mitsumori et al. | 430/96 |
| 2003/0087173 | A1 * | 5/2003 | Kumano et al. | 430/96 |
| 2004/0259009 | A1 * | 12/2004 | Itami et al. | 430/60 |
| 2005/0064318 | A1 * | 3/2005 | Shida et al. | 430/126 |
| 2006/0121376 | A1 * | 6/2006 | Takenouchi | 430/60 |

FOREIGN PATENT DOCUMENTS

| | | |
|---|---|---|
| JP | 2000-206710 | 7/2000 |
| JP | 2001-201876 | 7/2001 |
| JP | 2002-229241 | 8/2002 |
| JP | 2002-287369 | 10/2002 |
| JP | 2003-066639 | 3/2003 |

* cited by examiner

*Primary Examiner*—Mark F Huff
*Assistant Examiner*—Rachel L Zhang (Burney)
(74) *Attorney, Agent, or Firm*—Finnegan, Henderson, Farabow, Garrett & Dunner, L.L.P.

(57) ABSTRACT

A photoreceptor for electrophotography is disclosed. Thickness of the under coat layer is 6-15 μm, thickness of the charge transport layer is 5-15 μm, and coefficient of working function of the under coat layer α is not more than 0.8.

28 Claims, 5 Drawing Sheets

IMAGE FORMING METHOD

FIELD OF THE INVENTION

The present invention relates to an electrophotographic photoreceptor, a processing cartridge, an image forming apparatus and an image forming method to be employed for image forming by an electrophotographic system, and relates in detail to an electrophotographic photoreceptor, a processing cartridge, an image forming apparatus and an image forming method to be employed for image forming by an electrophotographic system to be applied in the field of copying machines and printers.

For a high image quality in electrophotographic images, there have been developed technologies that form a minute latent image, by the use of an exposure light source with a small spot diameter, on an organic photoreceptor to form a minute dot image. For example, there is known a method of forming a latent image with a high resolution on an organic photoreceptor, using a light source with a spot diameter not greater than 4000 μm (Patent Document 1 described later). In order to form a precise latent image by this small spot diameter exposure method, it is significant, when forming the latent image on an organic photoreceptor through image-wise exposure, to reduce diffusion of electric charge carriers which are generated by light exposure. In other words, it is necessary to secure an enough electric potential contrast between exposed and unexposed parts to accurately reproduce image data as an electrostatic latent image, and to achieve this, it is important to reduce diffusion of carriers before the generated carriers reach surface charges. It is reported (in Non-patent Document 1 described later) that if the ratio D/μ of a diffusion constant (D) to a drift mobility (μ) is great, influence of diffusion during electrostatic latent image forming is not negligible for image degradation of an image with a high density such as 1200 dpi for example, wherein, if the layer thickness of the charge transport layer is larger, degradation of latent images is greater. Further, it is also reported (in Non-patent Document 2 described later) that diffusion of latent images is greater with a greater drift mobility (μ) of the charge transport layer, according to the analysis result of a single dot latent image. Therefore, for a process with high resolution, an organic photoreceptor that has a thin charge transport layer to prevent diffusion of electrostatic latent images has been already offered (Patent Document 2).

However, these offered organic photoreceptors are not sufficient solutions in respect of the durability of a photoreceptor. Specifically, charging performance and sensitivity of an organic photoreceptor are greatly dependent on the layer thickness, in general, and decrease in the layer thickness due to repeated use tends to cause an increase in image defects such as fogging and black spots. Particularly, in an organic photoreceptor with a thin photoreceptive layer, loading conditions of charging potential when forming an electrostatic latent image tend to increase the electric filed intensity per unit layer thickness, which easily causes problems such as degradation of dot images and a rise of residual electric potential both resulting from repeated use.

Further, in recent electrophotographic apparatuses such as digital copying machines and printers, downsizing and speedup as well as high image quality have been achieved, and both a high sensitivity to respond to high speed, and a long life by improved abrasion resistance are required as characteristics of a photoreceptor.

Further, in recent electrophotographic apparatuses such as digital copying machines and printers, downsizing and speedup as well as high image quality have been achieved, and both a high sensitivity to respond to high speed, and a long life by improved abrasion resistance are required as characteristics of a photoreceptor.

To meet the above-mentioned requirements of high image quality, downsizing, and speedup, it is required to improve the time responsibility of the sensitivity of a photoreceptor. To satisfy these requirements, there have been made efforts to develop a charge generating material with a high sensitivity. As a result, as a representative charge generating material with a high sensitivity, phthalocyanine pigments (titanyl phthalocyanine pigments having a maximum peak of Bragg angle 2θ at 27.3 degrees for a spectrum of characteristic X ray of CU—Kα) such as Y-type phthalocyanine have been developed, and electrophotographic photoreceptors employing such a pigment have been put into practical use (Non-patent Document 3). However, in a high speed image forming process in which the line speed of a photoreceptor is high, and charging time and moving time from an exposure process to a development process are short, these electrophotographic photoreceptors tend to be subjected to unsteadiness in charging potential, degradation of dot images, a rise of residual electric potential, fogging, and a drop in image density.

Namely, in an organic photoreceptor required to have a high image quality and a high speed, a change in the layer thickness of the photoreceptor due to repeated use affects the size of an electrostatic latent image of a dot image and forming of a potential contrast, thereby easily causing degradation of dot images, a rise of the residual electric potential, fogging, and a drop in image density.

Particularly in the case of a print image of a photographic image, wherein a dot image with a resolution higher than 1200 dpi is required, and a tone reproducibility is emphasized, degradation of dot images caused by a decrease in layer thickness of a photoreceptor tends to be generated, which needs to be prevented.

Patent Document 1: JP 08-272197 A

Patent Document 2: JP 05-119503 A

Non-patent Document 1: Journal of the Imaging Society of Japan (Nihon Gazo Gakkai-shi) Vol. 38, No. 4, page 296

Non-patent Document 2: Fuji Jiho Vol. 75, No. 3, page 194

Non-patent Document 3: Denshi Shashin Gakkai-shi (Electrophotography, the society journal) 29 (3), 250 (1990)

An object of this invention is to provide a photoreceptor for an image forming method with high resolution over 1,200 dpi, by which deterioration of broadening or contrast of latent dot image and lowering of image density are minimized, and an image with high contrast and high resolution is obtained, even when thickness decreases due to abrasion for long term.

The organic photoreceptor employed in this invention comprises an under coat layer, a charge generation layer and a charge transport layer provided on a substrate, thickness of the under coat layer being 6-15 μm, thickness of the charge transport layer being 5-15 mm, and under coat layer satisfying inequality $\alpha \leqq 0.8$, α being a gradient of a straight line linearly approximated by the following formula (a):

$$\phi_{UCL}=\alpha\cdot\phi_M+\beta \qquad \text{(a) } (\alpha,\beta\text{:constant})$$

wherein $\phi_{UCL}$ represents work function of the under coat layer, and $\phi_M$ represents work function of the conductive electrode material, both of work function are obtained by measuring a contact potential difference for conductive electrode materials.

A toner image is formed by a method comprising steps of: electrically charging an organic photoreceptor; imagewise exposing the photoreceptor digitally with resolution of 1,200 dpi or more so that a latent image is formed on the photoreceptor; developing the latent image with toner so that a toner image is formed on the photoreceptor. The toner image on the photoreceptor may be transferred to an image providing material.

Thickness of photosensitive layer of photoreceptor is made thin so as to improve reproduction of high quality dot image, and thickness of the under coat layer is made thick so as not to vary electric field strength per unit thickness of photosensitive layer even when thickness decreases due to abrasion for long term, and further, under coat layer provided between an electroconductive support and the photosensitive layer has a specific work function in the present invention.

The under coat layer preferably contains N-type semiconductive particles, the preferable example of which is anatase type titanium oxide.

The under coat layer preferably comprises a resin having an organic segment component and an inorganic segment component.

The value $\alpha$ is preferably from 0.3 to 0.8.

Charging potential of the electrically charging the organic photoreceptor is preferably 200 to 400 volts.

The photoreceptor can be employed in a process cartridge, detachably mounted on a main body of an image forming apparatus, and having at least one of a charging device, developing device, a transfer device and a cleaning device.

The photoreceptor can be employed in an image forming apparatus.

BRIEF DESCRIPTIONS OF THE DRAWINGS

DETAIL DESCRIPTION OF THE INVENTION

Figure 1:
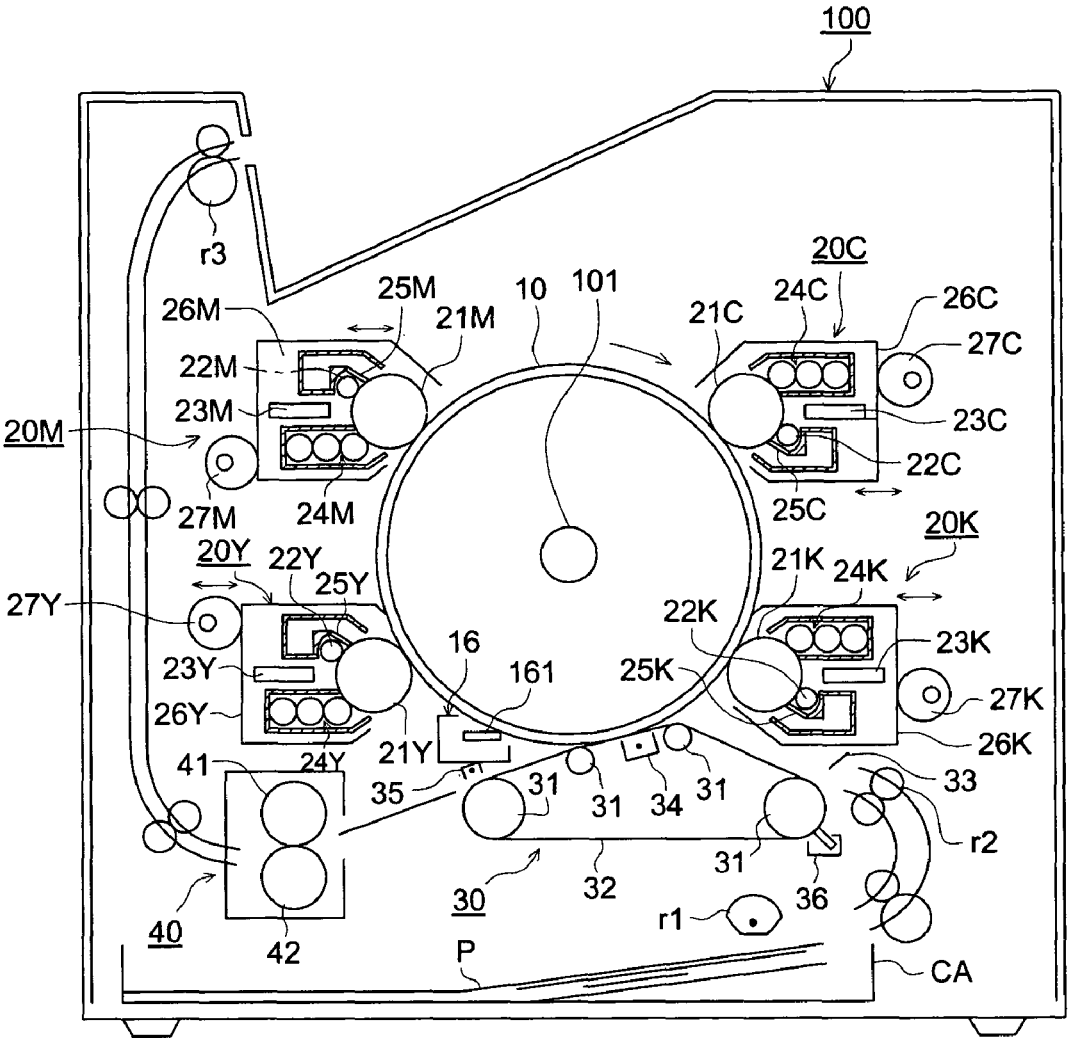
FIG. 1 is a cross-sectional construction diagram showing an example of an image forming apparatus of a tandem intermediate transfer type.

The photoreceptor employed in this invention comprises an under coat layer, a charge generation layer and a charge transport layer provided on a substrate, thickness of the under coat layer being 6-15 μm, thickness of the charge transport layer being 5-15 μm, and under coat layer satisfying inequality $\alpha \leqq 0.8$, $\alpha$ being a gradient of a straight line linearly approximated by the following formula (a):

$$\phi_{UCL}=\alpha\cdot\phi_M+\beta \qquad \text{(a) } (\alpha,\beta\text{:constant})$$

wherein $\phi_{UCL}$ represents work function of the under coat layer, and $\phi_M$ represents work function of the conductive electrode material, both of work function are obtained by measuring a contact potential difference for conductive electrode materials. This photoreceptor can form a fine dot latent image having resolution over 1,200 dpi, and form a high quality toner image having resolution over 1,200 dpi when thickness decreased after long term use, and minimize change of electrophotographic image quality to give good fine line reproduce ability, gradation, sharpness and restrained deterioration of color image.

The invention is detailed more.

An organic photoreceptor is a photoreceptor containing an organic material which functions at least one of charge generation and charge transport. It includes any photoreceptors comprising, such as, an organic CGM or CTM, or a photoreceptor comprising polymer complex having both charge generation and charge transport functions.

The charge transport layer (CTL) is a layer having function that transports charge generated in a charge generation layer (CGL) due to light exposure to a surface of the organic photoreceptor. The charge transfer function can be confirmed by detecting photoconductivity of laminated material of CGL and CTL on an electroconductive substrate.

The photoreceptor is composed of fundamentally a CTL and CGL provides on an under coat layer which is provided on an electroconductive substrate.

The specific structure of a photoreceptor to be used in the invention will be described below.

Conductive Support

A conductive support to be used in a photoreceptor of the invention has a sheet shape or a cylindrical shape.

A conductive support in a cylindrical shape in the invention means one that is necessary for endless forming of images by rotation, and it is preferably a conductive support having a straightness not greater than 0.1 mm and a run-out not greater than 0.1 mm. If the straightness and the run-out exceed these ranges, satisfactory image forming is difficult.

As a material to be used for the conductive support, there are given metal drums of aluminum, nickel, and the like, or plastic drums evaporated with aluminum, tin oxide, indium oxide, and the like, or paper/plastic drums coated with a conductive material. A conductive support preferably has a specific resistance equal to or smaller than $10^3$ Ωcm at a normal temperature.

A conductive support to be used in the invention may have a sealed alumite film formed on the surface thereof. Alumite processing is usually performed in an acid bath of chromic acid, sulfuric acid, oxalic acid, phosphoric acid, boric acid, sulfamic acid, or the like, wherein anodizing in sulfuric acid gives the most preferable result. In the case of anodizing in sulfuric acid, anodizing is preferably performed with a sulfuric acid concentration ranging from 100 to 200 g/l and aluminum ion concentration ranging from 1 to 10 g/l at a temperature of around 20° C., and with an applied voltage of about 20 V, but not limited to this. The average film thickness of the anodized layer is preferably equal to or smaller than 20 μm in usual cases, and it is especially preferable to be equal to or smaller than 10 μm.

Under Coat Layer

Under coat layer is provided between the base and CGL has a thickness of 6-15 μm, and has $\alpha$ of not more than 0.8. The under coat layer restrains injection of charge from the electroconductive base, and deterioration of residual potential or charge potential is kept low, even though the thickness of the under coat layer is 6-15 mm comparative with a thickness of CTL. Charge potential sufficient to form an image can be given to a photoreceptor despite such thinner CTL as 5-15 μm because a thick undercoat layer is provided.

Formula (a), regarding work function of the under coat layer, is detailed.

Work function of the under coat layer is given by measuring contact potential difference varying species of conductive electrode materials employing Formula (a). A method named "Kelvin method" is employed for measuring the work function. The Kelvin method and measuring method of the work function is described in "Interface and Colloid", Shin Jikken Kagaku Koza, pp 181-192, Nihon kagaku kai (Japan Chemical Association).

Work function of the under coat layer is measured by potential difference of sample providing under coat layer on an electroconductive support between under coat layer surface and metal electrode (counter electrode). Though the under coat layer is kept in contact with the metal electrode via sample electrode, contact potential difference becomes constant irrespective to metal species interposed when sufficient electron transition occurs from high Fermi level to low level via contact interface to become equilibrium, and therefore, the work function should become constant. However, work function of the under coat layer changes depending on work function of sample electrode in actual measurement.

This means the contact equilibrium state is different from ideal electron transmission and reflects electron characteristics of the under coat layer.

Figure 5:
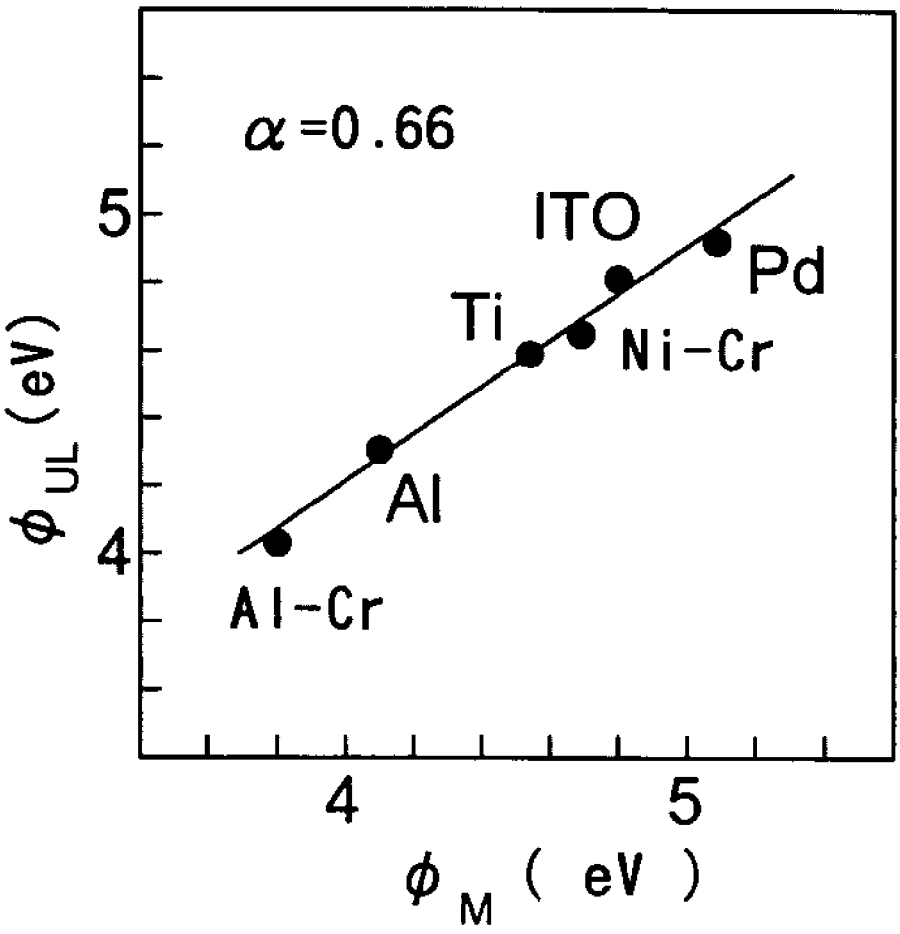
FIG. 5 is a plot graph of working function of under coat layer of photoreceptor group 1.

Practically the work function is measured as follows. Samples for measurements are prepared by spin coating an under coating layer coating composition on each of electrodes composed of, for example, palladium (Pd), indium tin oxide (ITO), nickel-chromium alloy (Ni—Cr), titanium (Ti), aluminum (Al), aluminum-chromium alloy (Al—Cr), etc., followed by drying. The contact potential difference of each sample is measured using the Kelvin method under ambient atmosphere. The work function $\phi_{UCL}$ of the under coat layer thus obtained was plotted versus the corresponding work function $\phi_M$ of sample electrode measured without applying under coat layer. FIG. 5(*a*) shows an example of plotting of work function of under coat layer of photoreceptor.

Gradient $\alpha$ of liner relation between $\phi_{UCL}$ and $\phi_M$ is not more than 0.8. Among the carriers generated in CGL, electron injection property to the under coat layer is improved, and therefore, characteristics of low increase of residual potential is obtained and further charge injection from the electroconductive base is restrained effectively, when $\alpha$ is not more than 0.8.

Minimum limit of $\alpha$ is zero, but preferably 0.3, and more preferably 0.5 or more. In this instance, an adequate thermal excitation carrier from CGL injects and dark decay of charge is maintained preferably.

The under coat layer is detailed.

The under coat layer preferably is a resin layer in which particles of N-type semiconductive material is dispersed to obtain characteristics mentioned above.

An electron works as an electroconductive carrier in N-type semiconductive material. Therefore, under coat layer of insulating resin containing particles of N-type semiconductive material blocks hole injection from base effectively and blocks electron from photosensitive layer slightly.

Example of the particles of N-type semiconductive material is zinc oxide, titanium oxide and so on, and anatase titanium dioxide is preferable among them.

The anatase type titanium oxide particle is preferably fine particles having a number average diameter of primary particle of from 5 to 400 nm. The number average diameter of primary particles is defined by the value measured as the average diameter in the FERE direction by image analysis of 100 particles randomly selected from the electron microscopic photograph of the fine particles with a magnification of 10,000.

Anatase type titanium oxide containing niobium element in an amount of from 100 ppm to 2.0% by weight is preferable. The rectification ability of titanium oxide is stably displayed through a long using period of the photoreceptor by the addition of niobium element and the dielectric breakdown and the black spot are prevented and the variation of the charging property and the light-sensitivity sensitivity of the photoreceptor is small even when the environmental conditions of temperature and humidity are varied.

The content of niobium element is more preferably from 300 ppm to 1.8% by weight.

The concentration of niobium element in the anatase type titanium oxide can be measured by quantitative analysis by ICP (inductively coupled plasma light emission analysis method).

The anatase type titanium oxide can be prepared by a sulfuric acid method. A solution containing titanium sulfate or titanyl sulfate was heated for prepare a hydrated titanium dioxide slurry by hydrolysis, and the titanium dioxide slurry is dehydrated by baking to obtain the anatase type titanium oxide. Preparation method of the anatase type titanium oxide containing niobium element is described below.

Niobium sulfate is added to hydrate titanium dioxide slurry obtained by hydrolysis of an aqueous solution of titanyl sulfate. Suitable adding amount of niobium is from 0.15 to 5% by weight in terms of niobium ion to the amount of the titanium in terms of titanium dioxide. In concrete, (i) a hydrated titanium dioxide slurry obtained by hydrolysis of an aqueous solution of titanyl sulfate to which 0.15 to 5% by weight of niobium sulfate in terms of niobium ions or (ii) a hydrate titanium dioxide slurry obtained by hydrolysis of an aqueous solution of titanyl sulfate to which 0.15 to 5% by weight of niobium sulfate in terms niobium ions is added, may be employed.

The hydrated titanium dioxide slurry is dehydrated and baked. Suitable baking temperature is usually from 850 to 1,100° C. The anatase type titanium oxide can be obtained by such the method, which has an average diameter of the primary particles of from 0.01 to 10 μm and contains niobium element in an amount of from 100 ppm to 2% by weight of.

There is a way for preparing titanium oxide by a gas burning method using titanium tetrachloride. In such the case, anatase type titanium oxide containing no or almost no another metal element such as niobium can be obtained if any metal halide component is not brought.

The anatase ratio of the anatase type titanium oxide is preferably for 90 to 100%. The anatase type titanium oxide having the anatase ratio of almost 100% can be prepared by the foregoing methods. The under coat layer has rectification property can be suitably and stably obtained since the under coat layer contains the anatase type titanium oxide containing niobium element.

The anatase ratio is a value defined according to the following equation based on the measuring results of the intensity IA of the strongest diffraction line of anatase (face index of 101) and the intensity IR of the strongest diffraction line of rutile (face index of 110).

$$\text{Anatase ratio (\%)}=100/(1+1.265\times IR/IA)$$

For preparing the titanium oxide having an anatase ratio of from 90 to 100%, the anatase type titanium oxide having an anatase ratio of almost 100% can be obtained by hydrolysis by heating of a solution containing titanium sulfate or titanyl sulfate as titanium compound. Titanium oxide having high anatase ratio can be obtained by neutralizing an aqueous solution of titanium tetrachloride by an alkali.

Coefficient $\alpha$ in the formula (a) of work function of the under coat layer is controlled by modifying particle diameter, surface processing of the anatase titanium oxide particles or content of titanium oxide particles. Anatase titanium oxide has strong N-type property inherently, and the N-type property can be controlled by degree of surface processing whereby α value can be controlled.

It is preferable that the anatase type titanium oxide is subjected to a surface treatment by a reactive organic silicon compound. The surface treatment of the anatase type titanium oxide by the reactive organic silicon compound can be performed by the following wet method. The surface treatment by the reactive organic silicon compound is performed by a treating solution employing a reactive organic silicon compound.

The anatase type titanium oxide is added to a liquid composed of an organic solvent or water in which the reactive organic silicon compound is dissolved or dispersed, and the resultant mixture is dispersed for a period of from several minutes to about 24 hours. The dispersion is subjected to heating treatment according to the case. Then the titanium oxide is filtered and dried to obtain the anatase type titanium oxide coated with the organic silicon compound. The reactive organic silicon compound may be added to the dispersion composed of the organic solvent or water in which the titanium oxide is dispersed.

The amount of the reactive organic silicon compound to be employed for the surface treatment is from 0.1 to 10, and preferably from 0.1 to 5, parts by weight to 100 parts by weight of the anatase type titanium oxide on the occasion of the surface treatment. By such the treatment, sufficient rectification effect, dispersing ability, photographic properties, remaining potential and charging potential can be obtained.

Examples of the reactive organic silicon compound are ones represented by the following Formula 2. The compound is not limited to the followings as long as the compound is capable of condensing reacting with the reactive group at the surface of titanium oxide such as a hydroxyl group.

$$(R)_n\text{—Si-}(A)_{4-n} \qquad \text{Formula 2}$$

In the above formula, Si is a silicon atom, R is an organic group directly bonded to the silicon atom, A is a hydrolysable group and n is an integer of from 0 to 3.

Examples of the organic group represented by R which is directly bonded with the silicon include an alkyl group such as a methyl group, an ethyl group, a propyl group, a butyl group, a pentyl group, an octyl group and a dodecyl group; an aryl group such as a phenyl group, a tolyl group, a naphthyl group and a biphenyl group; an epoxy-containing group such as a γ-glycidoxypropyl group and β-(3,4-epoxycyclohexyl) ethyl group; a (meth)acryloyl-containing group such as a γ-acryloxypropyl group and a γ-methacryloxypropyl group, a hydroxyl-containing group such as a γ-hydroxypropyl group and a 2,3-dihydroxypropyloxypropyl group; a vinyl-containing group such as a vinyl group and a propenyl group; a mercapto-containing group such as a γ-mercaptopropyl group; an amino-containing group such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluorooctylethyl group; a nitro- or cyan-substituted alkyl group. Examples of the hydrolyzable group represented by A include an alkoxyl group such as a methoxy group and an ethoxy group, a halogen and an acyloxy group.

The organic silicon compounds represented by Formula 2 may be employed singly or in a combination of two or more kinds thereof.

In the organic silicon compound represented by Formula 2, plural groups each represented by R may be the same as or different from each other when n is 2 or more. Plural groups represented by X may be the same as or different from each other when n is 2 or more. When two or more kinds of the organic silicon compounds represented by Formula 2 are employed, groups each represented by R and A of the individual compounds may be the same as or different from each other.

Polysiloxane compounds are preferable as the reactive organic silicone compound. Methylhydrogenpolysiloxanes are particularly preferred. As such the compound, one having a molecular weight of from 1,000 to 20,000 is easily available and displays suitable black spot preventing effect.

Another method for the surface treatment of the titanium oxide is carried out by the use of an organic silicon compound having a fluorine atom. The surface treatment using the organic silicon compound having a fluorine atom is preferably preformed by the wet method.

In the invention, it is confirmed that the surface of titanium oxide is covered by the reactive organic silicon compound by a combination of surface analysis method such as electron spectroscopy for chemical analysis (ESCA), Auger electron spectroscopy, secondary ion mass spectrometry (SIMS) and scatter reflection FI-IR.

Other than the above, the surface treatment may be performed by at least one selected from alumina, silica and zirconia.

The alumina, silica and zirconia treatments are each a treatment for depositing alumina, silica and zirconia on the surface of the anatase type titanium oxide, respectively. It is particularly preferred that the alumina treatment is performed at first and followed by the silica treatment, even though both of the treatments may be simultaneously applied. In the case of the alumina and silica treatments are separately applied, it is preferred that the amount of the silica is larger than that of the alumina.

The surface treatment of the titanium oxide by the metal oxide such as alumina, silica and zirconia can be performed by a wet method. For example, the surface treatment by the alumina, silica or zirconia can be performed as follows.

When the anatase type titanium oxide is employed, the titanium oxide particles having a number average premier particle diameter of 50 nm was dispersed in from 50 to 350 g of water to form aqueous slurry, and a water-soluble silicate or a water-soluble aluminum compound was added to the slurry. And then the slurry is neutralized by adding an alkali or an acid so as to separate silica or alumina onto the surface of the titanium oxide particle. Thereafter, the titanium oxide particles are filtered, washed and dried to obtain the objective surface treated titanium oxide. When sodium silicate is employed as the water-soluble silicate, the neutralization can be carried out by an acid such as sulfuric acid and hydrochloric acid. When aluminum sulfate is used as the water-soluble aluminum compound, the neutralization can be carried out by an alkali such as sodium hydroxide and potassium hydroxide.

The amount of the metal oxide to be used for the surface treatment is preferably from 0.1 to 50 parts, more preferably from 1 to 10 parts, by weight to 100 parts by weight of the titanium oxide in terms of the weight on the occasion of the start of the surface treatment. In the foregoing case using the alumina and silica for the surface treatment of the anatase type titanium oxide, it is preferably that the alumina and silica are each employed in an amount of from 1 to 10 parts by weight to 100 parts of the titanium oxide, respectively, and the amount of the silica is preferably larger than that of the alumina.

The under coat layer according to the invention is substantially an insulation layer. The volume resistivity of the insulation layer is not less than $1\times10^8\Omega\cdot$cm. By the under coat layer having such the resistivity, sufficient charge blocking ability of the under coat layer can be obtained and the occurrence of the black spots and the remaining potential of the photoreceptor are inhibited so that the remaining potential during the repeating of image formation is stabilized and good image can be obtained. The volume resistivity of the under coat layer and the protective layer is preferably from $1\times10^{8}$ to $1\times10^{15}\Omega\cdot$cm, more preferably from $1\times10^{9}$ to $1\times10^{14}\Omega\cdot$cm, and further preferably from $2\times10^{9}$ to $1\times10^{13}\Omega\cdot$cm. The volume resistivity can be measured as follows.

Measuring condition: According to JIS C2318-1975

Measuring apparatus: Hiresta IP manufactured by Mitsubishi Yuka Co., Ltd.

Measuring condition: Measuring prove HRS

Applied voltage: 500 V

Measuring environment: 32±2° C., 80±5% RH

The coating composition for forming the under coat layer contains the metal oxide particles such as the surface treated titanium oxide, binder resin and a dispersion medium.

The under coat layer contains the metal oxide particles in a ratio of from 1 to 10,000, and preferably from 50 to 1,000, parts by weight to 100 parts of the binder resin. Under such the condition, the dispersing state of the metal oxide particles can be sufficiently maintained and the satisfactory under coat layer can be formed in which the occurrence of the dielectric breakdown and the black spots is inhibited and the potential variation is small.

As the binder for dispersing the particles and forming the under coat layer, polyamide resins are preferable for obtaining good dispersing state, and a hardenable resins containing an organic segment component and an inorganic segment component shown below are particularly preferred.

The under coat layer preferably contains a binder resin having an organic segment component and an inorganic segment component. The binder resin preferably contains an anti-oxidation structural component.

The organic segment component is a chain component forming a resin which has a recurring unit formed by organic substance containing carbon atom among chain structure. For example, it includes chain structure component composing a resin such as vinyl resin, polyester resin, and polycarbonate resin. The resin forming the under coat layer contains the organic segment component as well as an inorganic segment component.

The organic segment component is preferably a segment component which is polymerized from a chain polymerizable monomer. The organic segment component is a vinyl resin component, preferably obtained by chain polymerization of a chain polymerizable monomer such as acrylic ester or methacrylic ester.

The inorganic segment component is a component having a recurring unit formed of inorganic resin chain structure. Preferable example is siloxane condensation component having chain structure of silicon and oxygen.

A resin in which an organic segment component composed of vinyl resin component is bonded to siloxane condensed component as an inorganic segment component is described.

In order to connect siloxane condensation component to the organic segment chemically, polymerizable silane compound having polymerizable unsaturated group of carbon-carbon unsaturated bond of formula (1) shown below is made coexist at a time of forming organic segment, and the polymerizable silane composition is made reacted during proceeding of polymerization of chain polymerizable monomer (chain polymerizable monomer of an organic segment) at a time of forming the organic segment. A silyl modified organic segment, in which silyl group is introduced into the organic segment, is formed and thereafter siloxane condensation component (siloxane resin component) is formed on the silyl group or siloxane condensation component already formed is bonded.

Formula (1)

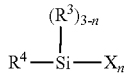

In the formula $R^3$ is an alkyl having carbon atoms of from 1 to 10 or an aralkyl having carbon atoms of from 1 to 10, $R^4$ is an organic group having polymerizable double bond, X is a halogen atom, an alkoxy, acyloxy, aminooxy or phenoxy group, n is an integer of from 1 to 3.

Polymerizable silane compound represented by Formula (I) is not particularly restricted as far as it comprises a silyl group, in particular, which has a hydrolysable group, and is capable of polymerization with various chain polymerizable monomers mentioned below. Examples of the polymerizable saline compound include:

$CH_2{=}CHSi(CH_3)(OCH3)_2$, $CH_2{=}CHSi(OCH_3)_3$, $CH_2{=}CHSi(OCH_3)Cl_2$, $CH_2{=}CHSiCl_3$, $CH_2{=}CHCOO(CH_2)_2Si(CH_3)(OCH_3)_2$, $CH_2{=}CHCOO(CH_2)_2Si(OCH_3)_3$, $CH_2{=}CHCOO(CH_2)_3Si(CH_3)(OCH_3)_2$, $CH_2{=}CHCOO(CH_2)_3Si(OCH_3)_3$, $CH_2{=}CHCOO(CH_2)_2Si(CH_3)Cl_2$, $CH_2{=}CHCOO(CH_2)_2SiCl_3$, $CH_2{=}CHCOO(CH_2)_3Si(CH_3)Cl_2$, $CH_2{=}CHCOO(CH_2)_3SiCl_3$, $CH_2{=}C(CH_3)COO(CH_2)_2Si(CH_3)(OCH_3)_2$, $CH_2{=}C(CH_3)COO(CH_2)_2Si(OCH_3)_3$, $CH_2{=}C(CH_3)COO(CH_2)_3Si(CH_3)(OCH_3)_2$, $CH_2{=}C(CH_3)COO(CH_2)_3Si(OCH_3)_3$, $CH_2{=}C(CH_3)COO(CH_2)_2Si(CH_3)Cl_2$, $CH_2{=}C(CH_3)COO(CH_2)_2SiCl_3$, $CH_2{=}C(CH_3)COO(CH_2)_2Si(CH_3)Cl_2$, $CH_2{=}C(CH_3)COO(CH_2)_3Si(CH_3)Cl_2$, and $CH_2{=}C(CH_3)COO(CH_2)_3SiCl_3$, and following compound.

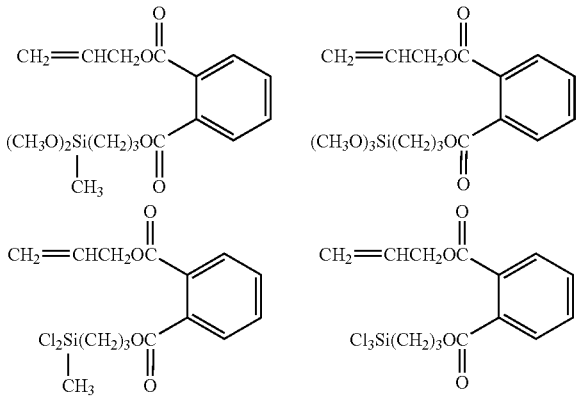

The silane compound can be employed singly or in plural in combination.

Examples of chain polymerizable monomer forming an organic segment component include (metha)acrylic acid esters such as methyl(metha)acrylate, ethyl(metha)acrylate, butyl(metha)acrylate, 2-ethylhexyl(metha)acrylate and cyclohexyl(metha)acrylate; carboxylic acids such as (meth) acrylic acid, itaconic acid and fumaric acid and acid anhydrides such as maleic anhydride; epoxy compounds such as glycidyl (metha)acrylate; amino compounds such as diethylaminoethyl (metha)acrylate and aminoethyl vinyl ether;

amide compound such as (metha)acrylamide, itaconyl diamide, α-ethylacrylamide, crotonylamide, fumaryldiamide, maleic acid diamide and N-butoxymethyl(metha)acrylamide; acrylonitrile, styrene, α-methylstyrene, vinyl chloride, vinyl acetate and vinyl propionate. Vinyl monomers each having a hydroxyl group such as 2-hydroxyethyl(metha)acrylate, 2-hydroxypropyl(metha)acrylate, 2-hydroxyvinyl ether and N-methylolacrylamide.

The under coat layer of the photoreceptor of the invention preferably comprises a binder resin which contains an organic segment component, an inorganic segment component and an anti-oxidizing structural component.

The anti-oxidizing structural component is a group having a resistively to oxidation or reduction caused by an active gas such as ozone and $NO_x$, or irradiation of ultra-violet rays.

The resin comprising an anti-oxidizing structural component has an anti-oxidizing structure such as a hindered amine group and a hindered phenol group in a part of resin structure. The anti-oxidizing structural component can be introduced in the organic segment component as a partial structure.

The resin containing an organic segment component, an inorganic segment component and an anti-oxidizing structural component can be obtained by forming an organic polymer having the anti-oxidation structural component and a silyl group using a polymerizable monomer capable of participating in the polymerization reaction to form an organic segment component, a monomer having the anti-oxidation structural component and a polymerizable silane compound, and by forming a siloxane condensate having the charge transportable structure to the silyl group of the organic polymer obtained as above.

The hindered amine group is a group or a derivative having steric hindrance near the nitrogen atom of an amino group of an amino compound. A branched alkyl group having three or more carbon atoms is preferred as the group having the steric hindrance.

The hindered phenol group is a group having the steric hindrance at the ortho-position with respect to the hydroxyl group of the phenol, provided that the hydroxyl group may be modified to an alkoxyl group. A branched alkyl group having three or more carbon atoms is preferred as the group with the steric hindrance.

The hindered amine group or the hindered phenol group can be introduced in the organic segment component as the partial structure of the polymer by co-existing a hindered amine monomer or a hindered-phenol monomer each having a polymerizable unsaturated group including an unsaturated carbon-carbon bond at the time of polymerization of the organic segment component so as to react the monomer with the progress of the polymerization of the organic segment component.

An amine monomer with steric hindrance including a polymerizable unsaturated group is preferred as such the hindered amine monomer having the polymerizable unsaturated group. A piperidine compound with steric hindrance having a polymerizable unsaturated group, hereinafter referred to as piperidine monomer, is particularly preferred. Typical examples of the piperidine monomer include compounds each represented by the following Formula A.

Formula A

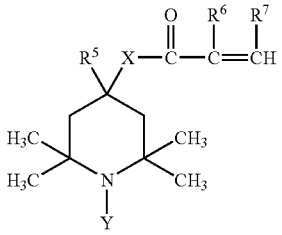

In Formula A, $R^5$ is a hydrogen atom or a cyano group, $R^6$ and $R^7$ are each a hydrogen atom, a methyl group or an ethyl group, $R^6$ and $R^7$ may be the same or different from each other, X is an oxygen atom or an imino group, Y is a hydrogen atom, an alkyl group having from 1 to 18 carbon atoms or a polymerizable unsaturated group represented by the following Formula B.

Formula B

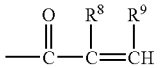

In Formula B, $R^8$ and $R^9$ are each a hydrogen atom, a methyl group or an ethyl group which may be the same or different from each other.

In Formula A, a hydrogen atom of the imino group represented by X may be unsubstituted or substituted. Examples of the alkyl group having from 1 to 18 carbon atoms represented by Y in Formula A include a linear- and branched-alkyl groups such as a methyl group, an ethyl group, an n-propyl group, an iso-propyl group, an n-butyl group, an iso-butyl group, a sec-butyl group, a t-butyl group, an n-pentyl group, n n-hexyl group, an n-heptyl group, an n-octyl group, an n-nonyl group, an n-decyl group, an n-undecyl group, an n-dodecyl group, an n-tetradecyl group, an n-pentadecyl group, an n-hexadecyl group, an n-heptadecyl group and an n-octadecyl group.

Preferable examples of the piperidine monomer represented by Formula A include 4-(metha)acryloyloxy-2,2,6,6-tetramethylpiperidine, 4-(metha)acryloylamino-2,2,6,6-tetramethylpiperidine, 4-(metha)acryloyloxy-1,2,2,6,6-pentamethylpiperidine, 4-(metha)acryloyl-amino-1,2,2,6,6-pentamethylpiperidine, 4-cyano-4-(metha)acryloyloxy-2,2,6,6-tetramethylpiperidine, 4-cyano-4-(metha)acryloylamino-2,2,6,6-tetramethyl-piperidine, 4-cyano-4-(metha)acryloyloxy-1,2,2,6,6-pentamethylpiperidine, 4-cyano-4-(metha)acryloylamino-1,2,2,6,6-pentamethylpiperidine, 1-(metha)acryloyl-4-(metha)acryloyloxy-2,2,6,6-tetramethylpiperidine, 1-(metha)aclyloyl-4-(metha)acryloylamino-2,2,6,6-tetramethylpiperidine, 1-(metha)aclyloyl-4-cyano-4-(metha)acryloyloxy-2,2,6,6-tetramethylpiperidine, 1-(metha)aclyloyl-4-cyano-4-(metha)acryloylamino-2,2,6,6-tetramethylpiperidine, 4-crotonoyloxy-2,2,6,6-tetramethylpiperidine, 4-crotonoylamino-2,2,6,6-tetramethylpiperidine, 4-crotonoyloxy-1,2,2,6,6-pentamethylpiperidine, 4-crotonoylamino-1,2,2,6,6-pentamethylpiperidine, 4-cyano-4-crotonoyloxy-2,2,6,6-tetramethylpiperidine, 4-cyano-4-crotonoylamino-2,2,6,6-tetramethylpiperidine, 1-crotonoyl-4-crotonoyloxy-2,2,6,6-tetramethylpiperidine, 1-crotonoyl-4-crotonoylamino-2,2,6,6-tetramethylpiperidine, 1-crotonoyl-4-cyano-4-crotonoyloxy-2,2,6,6-tetramethylpiperidine and 1-crotonoyl-4-cyano-4-crotonoylamino- 2,2,6,6-tetramethylpiperidine. Among them, 4-(metha) acryloyloxy-2,2,6,6-tetramethylpiperidine and 4-(metha) acryloyloxy-1,2,2,6,6-pentamethylpiperidine are particularly preferred.

Hindered phenol monomers each having a polymerizable unsaturated group is preferably used as the hindered phenol monomer. Examples of the hindered phenol monomer include the followings; 2-t-butyl-6-(3-t-butyl-2-hydroxy-5-methylbenzyl)-4-methylphenyl acrylate, 2-(3,5-di-t-butyl-4-hydroxyphenyl)ethyl acrylate, 2-(3,5-di-s-propyl-4-hydroxyphenyl)ethyl acrylate, 2-(3,5-di-t-octyl-4-hydroxyphenyl) ethyl acrylate, 2-{3-t-butyl-5-(3-t-butyl-2-hydroxy-5-methylbenzyl4-hydroxyphenyl}ethyl acrylate, 2-t-butyl-6-(3-t-butyl-2-hydroxy-5-methylbenzyl)-4-methylphenyl (metha)acrylate, 2-(3,5-di-t-butyl-4-hydroxyphenyl)ethyl (metha)acrylate, 2-(3,5-di-s-propyl-4-hydroxyphenyl)ethyl (metha)acrylate, 2-(3,5-di-t-octyl-4-hydroxyphenyl)ethyl (metha)acrylate, 2-(3-t-butyl-5-{3-t-butyl-2-hydroxy-5-methylbenzyl}4-hydroxyphenylethyl(metha)acrylate, vinyl 3,5-di-t-butyl-4-hydrozyphenyl-propionate, vinyl 3,5-di-t-octyl-4-hydrozyphenylpropionate, iso-propenyl 3,5-di-t-butyl-4-hydrozyphenylpropionate and iso-propenyl 3,5-di-t-octyl-4-hydrozyphenylpropionate.

Compound having anti-oxidation structure may be used singly or two or more in combination. The compound may have a hindered amine or hindered phenol or both.

Synthesis example of a silyl modified organic segment having hindered amine or hindered phenol is described. Synthesis example of Organic Segment Component A: Vinyl polymer having a hindered amine group and silyl modified Into a reaction vessel having a reflux condenser and a stirrer, 20 parts of γ-methacryloyloxypropyltrimethoxysilane, 2 part of 2-t-butyl-6-(3-t-butyl-2-hydroxy-5-methylbenzyl)-4-methylphenyl acrylate, 70 parts of methylmethacrylate, 40 parts of n-butylacrylate, 5 parts of acrylic acid, 13 parts of 2-ethylhexylmethacrylate, 1 part of 1,1,1-trimethylaminemethacrylimide, 150 parts of 2-propanol, 50 parts of 2-buthanone and 25 parts of methanol were charged and mixed. The mixture was heated to 80° C. with stirring, and solution in which 4 parts of azobisisovaleronitrile was dissolved in 10 parts of xylene was dripped over 30 minutes, it was allowed to react at 80° C. for 5 hours.

As the result vinyl polymer, which have a hindered amine group on the side chain and silyl group, and solid content of 40%, was obtained. It is referred as "Organic segment composition A".

Synthesis Example of Organic Segment Component B: Vinyl Polymer Having a Hindered Phenol Group and Silyl Modified Into a reaction vessel having a reflux condenser and a stirrer, 20 parts of γ-methacryloyloxypropyltrimethoxysilane, 2 part of 2-t-butyl-6-(3-t-butyl-2-hydroxy-5-methylbenzyl)-4-methylphenyl acrylate, 70 parts of methylmethacrylate, 40 parts of n-butylacrylate, 5 parts of acrylic acid, 13 parts of 2-ethylhexylmethacrylate, 1 part of 1,1,1-trimethylaminemethacrylimide, 150 parts of 2-proanol, 50 parts of 2-buthanone and 25 parts of methanol were charged and mixed. The mixture was heated to 80° C. with stirring, and solution in which 4 parts of azobisisovaleronitrile was dissolved in 10 parts of xylene was dripped over 30 minutes, it was allowed to react at 80° C. for 5 hours.

As the result vinyl polymer, which have a hindered phenol group on the side chain and silyl group, and solid content of 40%, was obtained. It is referred as "Organic segment composition B".

An organic segment component having hindered amine or hindered phenol groups on side chains and a silyl group (vinyl polymer component) can be obtained by polymerization of a polymerizable silane compound and a vinyl chain polymerizable monomer compound with a hindered amine or hindered phenol compound having polymerizable unsaturated group as demonstrated by Synthesis Examples above.

Polymerization degree of the organic segment component having a silyl group is preferably 100 to 500.

An under coat layer having a specific resin structure can be formed by employing the Organic Segment Component A or B, that is a vinyl polymer having silyl group, on which a siloxane condensation component is formed. A siloxane condensation component is formed on a silyl group of a vinyl polymer having silyl group by employing an organic silicon compound mentioned below. The condensation component may be formed at the same time as forming under coat layer, or the under coat may be formed after condensation component is formed at the end of silyl group in a coating composition for the under coating layer preliminary.

Siloxane condensation component has a structure in which a plurality of siloxane bonds are connected three dimensionally, and has a same structure of a resin obtained by condensation polymerization of organic compound represented by Formula (2).

Two or more R may be same or different when a plurality of organic silicon compounds represented by Formula (2) are used in preparation of siloxane condensation component.

Polymerization reaction of organic silicon compound is restrained in general when n is 3 wherein number of hydrolizable group connected to silicon atom is (4-n), of the organic siloxane compound mentioned above used as a start material of siloxane condensation component having cross-link structure. Polymerization reaction is easy to occur when n is 0, 1 or 2, and particularly cross-linking reaction progresses highly. Therefore, storability of coating composition, hardness of coat layer to be obtain are controlled by selecting compound having such number in the organic silicon compound.

The under coat layer comprises an organic segment component, an inorganic segment component, and a resin having anti-oxidant structure component, which are connected by chemical bond in the resin, and the under coat layer is formed by a resin having cross-linking structure as a whole.

Content ratio of the an organic segment component, an inorganic segment component, and a resin having anti-oxidant structure component is preferably that the inorganic segment component is from 0.25 to 4 and the resin having anti-oxidant structure component is 0.01 to 1 by weight parts to 1 part of the organic segment component. The ratio is selected in view of stable residual potential, stable image density in reversal development, coating characteristics of CGL, and electrophotographic characteristics such as charging, and sensitivity.

Photoreceptor

Charge Generating Layer

A charge generating layer contains a charge generating material (CGM). In addition, the charge generating layer may contain a binder resin and other additives as necessary.

As charge generating materials of the organic photoreceptor of the invention, phthalocyanine pigments, azo pigments, perylene pigments, azulenium pigments can be used solely or in combination. Among these pigments, titanyl phthalocyanine pigments, gallium phthalocyanine pigments, perylene pigments are preferably employed. For example, titanyl phthalocyanine pigments having a maximum peak of Bragg angle 2θ±0.2° for CU—Kα radiation at 27.2°, benzimidazole perylene having a maximum peak of 2θ of the same at 12.4°, chlorogallium phthalocyanine pigments having diffraction peaks of Bragg angle (2θ±0.2°) for a diffraction spectrum of characteristic X ray of CU—Kα at least at positions of 7.4°, 16.6°, 25.5°, and 28.3° in, and hydroxygallium phthalocyanine pigments having diffraction peaks of Bragg angle (2θ±0.2°) for a diffraction spectrum of characteristic X ray of CU—Kα at least at positions of 7.5°, 9.9°, 12.5°, 16.3°, 18.6°, 25.1°, and 28.1°, have almost no variation in charging performance and sensitivity due to repeated use, and are preferably used accordingly.

In case of using a binder as a dispersion medium of a CGM in the charge generating layer, a known resin can be employed as the binder, and the most preferable resins are formal resin, butyral resin, silicone resin, silicone modified butyral resin, phenoxy resin. The ratio of the binder resin to the charge generating material is preferably 100 weight parts of binder resin to weight parts of charge generating material of from 20 to 600. Increase in residual electric potential with repeated use can be minimized by using these resins. The layer thickness of a charge generating layer is preferably 0.1 to 2 μm.

Charge Transport Layer

CTL has preferably thickness of 5 to 15 mm, so that sufficient charge potential and potential contrast of a latent image can be obtained. As a result sharp image with minimized image blur and periodic image defect.

The charge transport layer of an organic photoreceptor of the invention is basically constructed of a charge transport material (CTM), a binder resin having a function to disperse the CTM and to form a layer, and the like.

As a charge transport material, for example, triphenylamine derivatives, hydrazone compounds, styryl compounds, benzidine compounds, butadiene compounds, oxazole derivatives, oxadiazole derivatives, thiazole derivatives, thiadiazole derivatives, triazole derivatives, imidazole derivatives, imidazolone derivatives, imidazoline derivatives, bis-imidazolidine derivatives, styryl compounds, hydrazine compounds, benzidine compounds, pyrazoline derivatives, stilbene compounds, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene, can be used solely or in combination. By combining a material, which is selected from these charge transport materials, with the above described charge generating material. It is preferable to select a charge transport material from triphenylamine derivatives, styryl compounds, benzidine compounds and butadiene compounds. These charge transport materials are usually dissolved into a proper binder resin, and thus, a layer is formed.

As a binder resin of a charge transport layer, one with a small dielectric constant is preferably used, including polystyrene resins, styrene-butadiene copolymers for example.

A charge transport layer may contain additives such as antioxidants.

As a binder resin to be used in the charge transport layer (CTL), although either a thermoplastic resin or a thermosetting resin can be used, a binder resin with a small dielectric constant is preferably used. Further, as a particularly preferable binder resin, it is especially preferable that polystyrene resin, styrene-butadiene copolymer, polycarbonate or the like, is used solely or in combination.

It is preferable that the ratio of a binder resin to a charge transport material is set as 100 weight parts of binder resin to weight parts of charge transport material ranging from 50 to 200.

Further, a charge transport layer may have a structure of a plurality of charge transport layers. The layer thickness of a charge transport layer is preferably 5 to 15 μm, mentioned above.

Solvents or dispersion agents which are used to form layers such as an under coat layer, a charge generating layer, a charge transport layer, etc. are n-butylamine, diethylamine, ethylenediamine, isopropanolamine, triethanolamine, triethylenediamine, N,N-dimethylformamide, acetone, methylethylketone, methylisopropylketone, cyclohexane, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethylsulfoxide, methyl Cellosolve, and the like. Although the invention is not limited to these, dichloromethane, 1,2-dichloroethane, methylethylketone and the like are preferably used. These solvents can be used solely or as a mixed solvent of more than one kind.

As a coating processing method for producing organic photoreceptors, a coating processing method such as immersion coating, spray coating, or circular amount control type coating is performed, wherein spray coating or the circular amount control type coating method (represented by a circular slide hopper type) is preferably used for uniform coating in order that a lower layer is not dissolved by coating of an upper layer of a photoreceptor. Incidentally, the circular amount control type coating method is most preferably used to coat a protective layer. The aforesaid circular amount control type coating is described in Japanese Patent Open to Public Publication No. 58-189061 in detail.

FIG. 1 is a cross-sectional construction diagram showing an example of an image forming apparatus of a tandem intermediate transfer system.

In this example, an image forming apparatus having a drum type intermediate transfer device superimposes color toners, the color toners being developing agents, on transfer device 10, thereby forms a color image, and transfers the color image onto recording sheet P which is a recording material, i.e., support of a final image being plain paper, transparent sheet, etc.).

Figure 2:
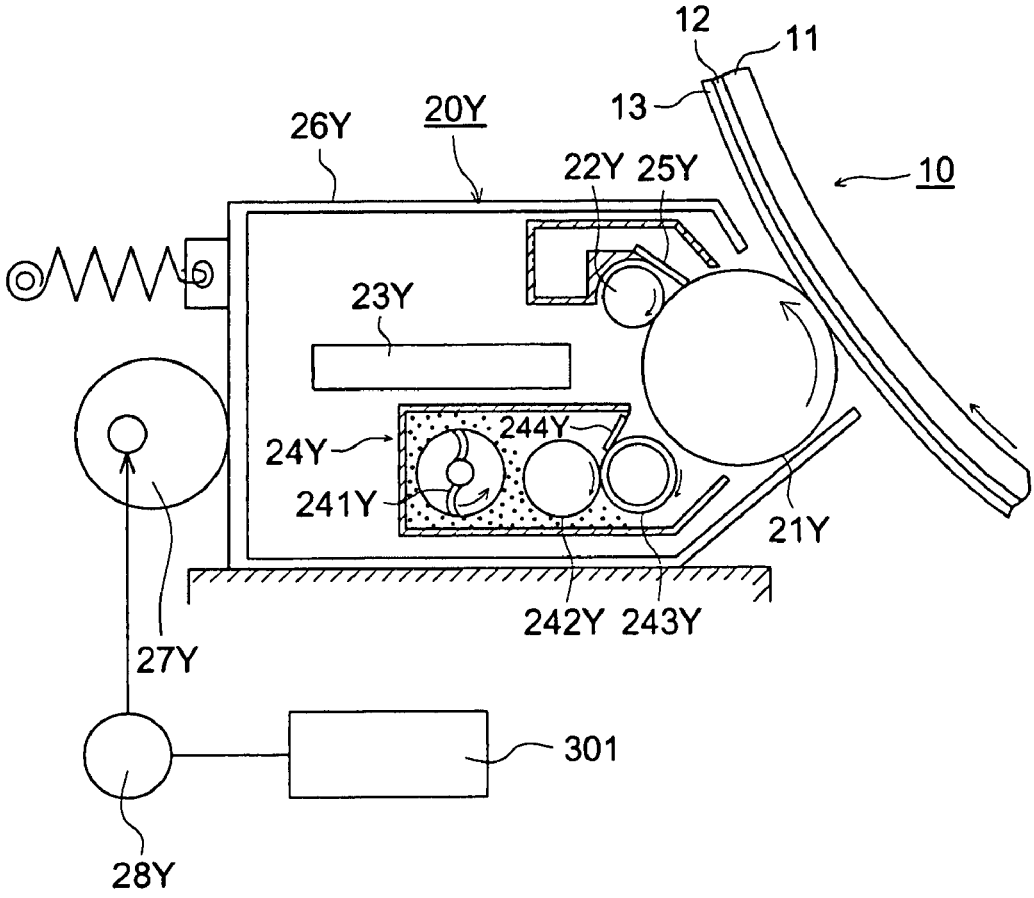
FIG. 2 is a cross-sectional construction diagram of an image forming unit to be used in an image forming apparatus of the invention.

Transfer device 10 sequentially superimposes and hold yellow (Y), magenta (M), cyan (C), and black (K) toner images formed by four image forming units 20Y, 20M, 20C, and 20K which are disposed around the transfer device 10. As shown in FIG. 2, the transfer device 10 is a drum shaped transfer member which is provided with conductive rubber layer 12 (an urethane rubber layer with a thickness of 500 to 5000 μm and an electrical resistance of $10^8$ to $10^{14}$Ω·cm) as an elastic layer on aluminum base member 11 which is a cylindrical metal base member, and separative film 13 (a Teflon®) layer for separation with a thickness of 20 to 200 μm and an electrical resistance of $10^{10}$ to $10^{16}$Ω·cm) on the transfer member 10. Around the transfer member 10, there are disposed the four image forming units 20Y, 20M, 20C, and 20K, recording sheet transfer device 30, and cleaning device 16. The transfer member 10 is supported by shaft 101 rotatably with respect to color image forming apparatus 100.

The four image forming units 20Y, 20M, 20C, and 20K are provided in respective frames 26Y, 26M, 26C, and 26K, the frames 26Y, 26M, 26C, and 26K being movably arranged in the color image forming apparatus 100; and there are provided moving members 27Y, 27M, 27C, and 27K for moving the respective image forming units to an image transfer position or a non image forming position, according to a color to be used, with respect to the drum-shaped transfer member 10, wherein the moving members are arranged to be in contact with the respective frames 26Y, 26M, 26C, and 26K. The moving members are moved by a driving device 28Y (FIG. 2) or 28C (FIG. 3) which is controlled by a control unit 301.

The four image forming units 20Y, 20M, 20C, and 20K are respectively comprised of photoreceptor drums 21Y, 21M, 21C, and 21K, and around the respective photoreceptor drums, rotatable charging devices 22Y, 22M, 22C, and 22K, image-wise exposure devices 23Y, 23M, 23C, and 23K, rotatable developing devices 24Y, 24M, 24C, and 24K, and cleaning devices 25Y, 25M, 25C, and 25K for cleaning the respective photoreceptor drums 21Y, 21M, 21C, and 21K.

The image forming units 20Y, 20M, 20C, and 20K are of the same structure except that the colors of toner images which the image forming units respectively form on the transfer member 10 are different, which will be explained below in detail referring to FIG. 2 (a cross-sectional construction diagram of an image forming unit to be used in the image forming apparatus of the invention), taking the case of the image forming unit 20Y.

In the image forming unit 20Y being provided in the frame 26Y, around the photoreceptor drum 21Y which is an image forming member, there are disposed the image forming member charging device 22Y (hereinafter, referred to merely as charging device 22Y or charger 22Y), the exposure device 23Y, the developing device 24Y, and the image forming member cleaning device 25Y (hereinafter referred to merely as cleaning device 25Y or cleaning blade 25Y), wherein the image forming unit 20Y forms a yellow (Y) toner image on the photoreceptor drum 21Y. In the present embodiment, the image forming unit 20Y is arranged such that the photoreceptor drum 21Y, the charging device 22Y, the developing device 24Y, and the cleaning device 25Y, at least, are integrally provided therein.

The charging device 22Y is a means for applying a uniform electric potential to the photoreceptor drum 21Y. In the present embodiment, charger 22Y in use has a roller shape, and comes in contact with and is rotated by the photoreceptor drum 21Y. Charging potential up to 1,000 volts can be applied to the photoreceptor according to the present invention. Charging potential preferably not more than 800 volts, more preferably about 200 to 400 volts is applied in an apparatus writing digital image with high resolution of 1,200 dpi or more. A dotted latent image with high fidelity to image exposure can be formed by employing lower voltage.

According to an image signal (yellow), the exposure device 23Y exposes light on the photoreceptor drum 21Y that is given a uniform potential by the roller shaped charger 22Y, and thereby forms an electrostatic latent image that corresponds to a yellow image. As the exposure device 23Y, there is used a device that is comprised of an LED in which luminous devices are disposed in an array in the axial direction of the photoreceptor 21Y and an image forming device (Brand name: Selfoclens), or a laser optical system, etc.

It is assumed that a digital image is written on an organic photoreceptor of the invention with a resolution of 1200 dpi or higher, and an electrostatic latent image is formed. In order to form an electrostatic latent image of a dot image with such a high resolution on the photoreceptor, it is preferable to use an exposure light beam having a spot area of $5.00\times10^{-10}$ $m^2$ (500 $\mu m^2$) or smaller to conduct image-wise exposure.

Even with such a small diameter beam light exposure, a photoreceptor of the invention can faithfully form an electrostatic latent image corresponding to the spot area, thereby achieving an electrophotographic image with a satisfactory sharpness and a high contrast, wherein the electrophotographic image is a dot image with a resolution of 1200 dpi (number of dots per 2.54 cm) or higher. The number of dots of a dot image formed on a photoreceptor of the invention is 1200 dip or higher, preferably in the range from 1200 to 3000 dpi, and more preferably 1200 to 2500 dpi. For a larger number of dots of a dot image, it is necessary to make the spot area of the exposure light beam smaller when exposing the light on the photoreceptor.

The spot area of the exposure light beam means the area corresponding to the region in which light intensity is not smaller than $1/e^2$ of a maximum peak intensity on a light intensity distribution plane that appears on a cross-section which is obtained by cutting the exposure light beam with a plane vertical to the beam.

For a light beam to be used, a scanning optical system employing a semiconductor laser, a solid scanner of LED or a liquid crystal shutter, or the like can be applied. Gauss distribution, Lorenz distribution, or the like can be applied as a light intensity distribution, wherein a spot area is defined by a region in which the light intensity is not smaller than $1/e^2$ of the respective peak intensity.

The developing device 24Y is a means for storing a yellow toner, which is a developing agent, and conducting reversal development of an electrostatic latent image formed on the photoreceptor drum 21Y to form a yellow toner image. In the developing device 24Y of the present embodiment, the yellow toner stored in the developing device 24Y is stirred with stirring member 241Y, and then is supplied to developing sleeve 243Y by toner supply roller 242Y which has an elastic surface (sponge) and rotates in the arrow direction, wherein the yellow toner on the developing sleeve 243Y is formed into an even thin layer by thin layer forming member 244Y. For the developing action by the developing device 24Y, a direct-current developing bias or one further added with an alternating current is applied to the developing sleeve 243Y rotating in the arrow direction; jumping development is performed by a component stored by the developing device 24Y; a bias in which a direct current component and an alternating current component of the same polarity as that of the toner are superimposed is applied to the grounded photoreceptor 21Y; and thus non-contact reverse development is performed. Incidentally, stopper rollers provided at both ends, outside of the image region, of the developing sleeve 243Y touch the photoreceptor drum 21Y so that the developing sleeve 243Y and the photoreceptor drum 21Y are maintained to have no contact with each other. Also, contact development can be applied instead of non-contact development.

The yellow toner image formed on the photoreceptor drum 21Y is sequentially transferred onto transfer member 10 to which a bias voltage with a polarity opposite to that of the toner is applied, while stopper rollers are rotating in contact with a position determination section of the transfer member 10.

The cleaning device 25Y is a means for removing residual yellow toner on the photoreceptor drum 21Y after the yellow toner image is transferred onto the transfer member 10. In the present embodiment, the residual toner is removed when the cleaning device 25Y rubs on the photoreceptor drum 21Y.

In such a manner, the yellow toner image, which corresponds to an image signal (yellow), formed by the image forming unit 20Y through charging, exposure, and development processes, is transferred onto the transfer member 10.

As shown in FIG. 1, also in the other image forming units 20M, 20C, and 20K, a magenta toner image corresponding to an image signal (magenta), a cyan toner image corresponding to an image signal (cyan), and a black toner image corresponding to an image signal (K) are likewise formed on the respective photoreceptor drums 21M, 21C, and 21K in parallel and in synchronization. The toner images formed on the respective photoreceptor drums 21Y, 21M, 21C, and 21K of the image forming units 20Y, 20M, 20C, and 20K by this operation, are sequentially transferred onto the transfer member 10 to which a transfer bias in the range from 1 to 2 kV has been applied, and the toner images are superimposed. When all the toner images are superimposed, a color toner image is formed on the transfer member 10.

On the other hand, sheet feeding cassette CA, which is a recording material storing device, is provided below the transfer member 10. Recording sheet P, which is a recording material stored in the sheet feeding cassette CA, is taken out of the sheet feeding cassette CA by operation of sheet feeding roller r1, and conveyed to a pair of timing rollers r2. The paired timing rollers r2 feed out the recording sheet P in synchronization with the color toner image formed on the transfer member 10.

The color toner image formed on the transfer member 10 is transferred by recording sheet transfer device 30 at a transfer position onto the recording sheet P thus fed out. The recording sheet transfer device 30 is comprised of grounded roller 31, transfer belt 32, paper charger 33, transfer electrode 34, and paper sheet separating AC neutralizer 35.

The recording sheet P thus fed out is trained about rollers 31, and conveyed to the transfer position by the transfer belt 32 rotating in the arrow direction in synchronization with the circumferential velocity of the transfer member 10. The transfer belt 32 is a belt-shaped one having a high resistance in the range from $10^6$ to $10^{10}\Omega\cdot$cm. In this operation, the recording sheet P is paper-charged to be of the same polarity as the toner by the paper charger 33 as a recording material charging device, and is absorbed by the transfer belt 32 to be conveyed to the transfer position. By paper-charging the recording sheet P to the same polarity as that of the toner, the recording sheet P and the color toner image on the transfer member 10 are prevented from attracting each other, thereby preventing degradation of the color toner image. As the recording material charging device, there is used an energizing roller, a brush charger, or the like which is attachable and detachable to and from the transfer belt 32.

The color toner image on the transfer member 10 is transferred onto the recording sheet P by the transfer electrode 34 at the transfer position. By this transfer electrode 34, a corona discharge is applied to the rear side of the recording sheet P so that the electric potential thereof becomes in the range from 1.5 to 3 kV, which is higher than that of the bias of the transfer member 10 and of a polarity opposite to that of the toner.

The recording sheet P, onto which the color toner image has been transferred, is further conveyed by the transfer belt 32, then, is neutralized by the paper sheet separating AC neutralizer 35 for separating recording materials, and is separated from the transfer belt 32 to be conveyed to fixing device 40. In the fixing device 40, the color toner image is heated and pressed by heat roller 41 and pressure roller 42, thus fused and fixed on the recording sheet P, and then, the recording sheet P is ejected by paired sheet ejection rollers r3 onto a tray provided on an upper part of the color image forming apparatus.

On the other hand, the transfer member 10 from which the color toner image has been transferred to the recording sheet P is slidingly rubbed by cleaning blade 161 of transfer member cleaning device 16, and thus, residual toner on the transfer member 10 is removed for cleaning. A blade of transfer belt cleaning device 36 slidingly contacts with the transfer belt 32 to clean the transfer belt 32 after the separation of the printing sheet.

Although the image forming unit shown in FIG. 2 is arranged to be a process cartridge which can attach and detach the developing device and the photoreceptor drum to and from the image forming unit, a process cartridge of the invention is not limited to this, and any process cartridge can be employed as long as the process cartridge includes at least one of a photoreceptor, a charging device, an image exposure device, a developing device, a transfer device, a separation device, and a cleaning device.

Figure 3:
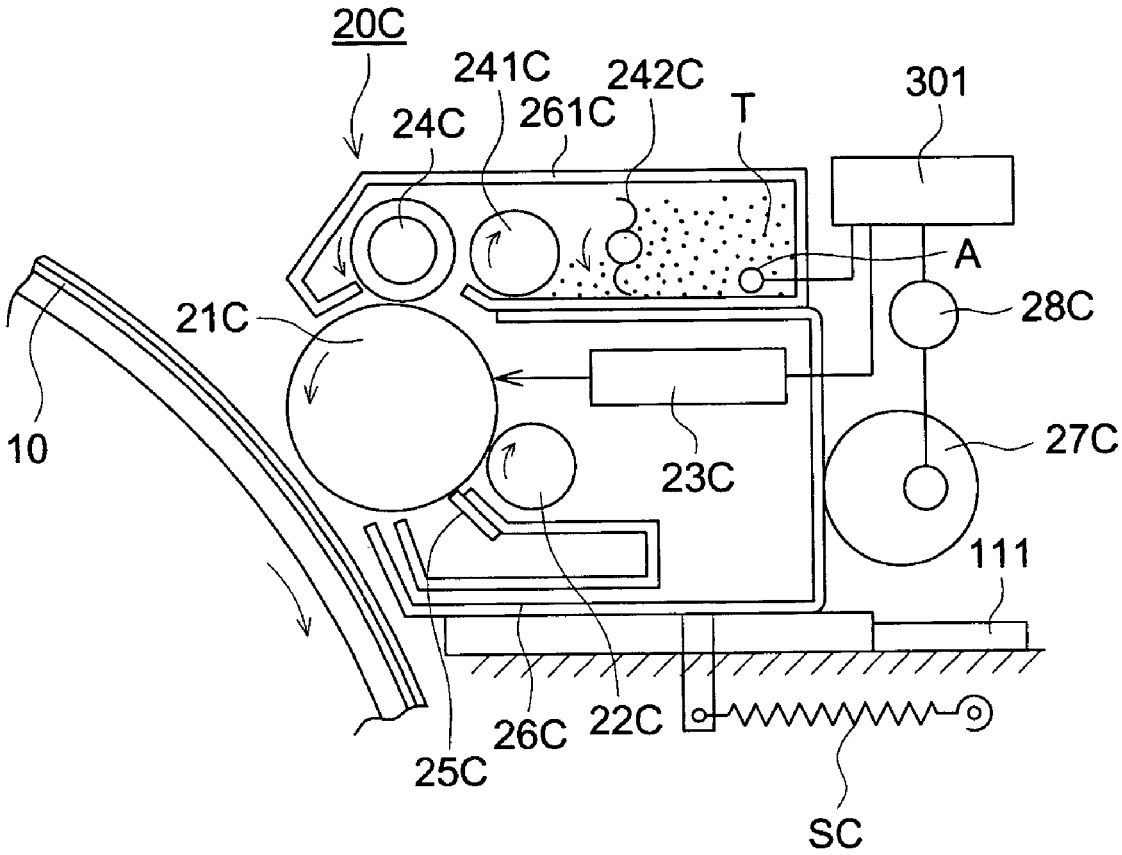
FIG. 3 is a cross-sectional construction diagram showing another example of an image forming unit to be used in an image forming apparatus of the invention.

FIG. 3 is a cross-sectional construction diagram showing another example of an image forming unit to be used in an image forming apparatus of the invention. FIG. 3 is a cross-sectional view of the image forming unit having a different structure from that of the image forming unit, shown in FIG. 2, and including a process cartridge that allows a developing device and a photoreceptor drum to attach and detach to and from the image forming unit.

The present embodiment will be described taking the case of the structure of image forming unit 20C.

Frame 26C constructing the image forming unit 20C is arranged at guide member 111 that is provided in the color image forming apparatus, and moving member 27C of a cam structure is arranged in contact with a part of the frame 26C, wherein the moving member 27C is stopping the image forming unit 20C together with the frame 26C at a predetermined image forming position against spring SC. In the frame 26C, charging device 22C and exposure device 23C are disposed around photoreceptor drum 21 that is an image forming member; and in second frame 261C serving as a replaceable process cartridge arranged to be attachable and detachable to and from the frame 26C, developing device 24C, developing agent supply device 241C, and developing agent stirring device 242C are provided, wherein the developing device 24C is disposed facing around the photoreceptor drum 21C.

Further, the second frame 261C stores a cyan (C) toner of a monocomponent developing agent T, and a developing agent remaining amount detecting device A for detecting the remaining amount of the monocomponent developing agent is arranged in the developing device 24C.

A cyan (C) toner image is formed on the photoreceptor drum 21C by the image forming process, and the cyan (C) toner image is transferred from the photoreceptor drum 21C to the transfer member 10 in the same way as described before, wherein cleaning device 25C is disposed to clean a surface of the photoreceptor 21C after the transfer of the cyan (C) toner image.

Figure 4:
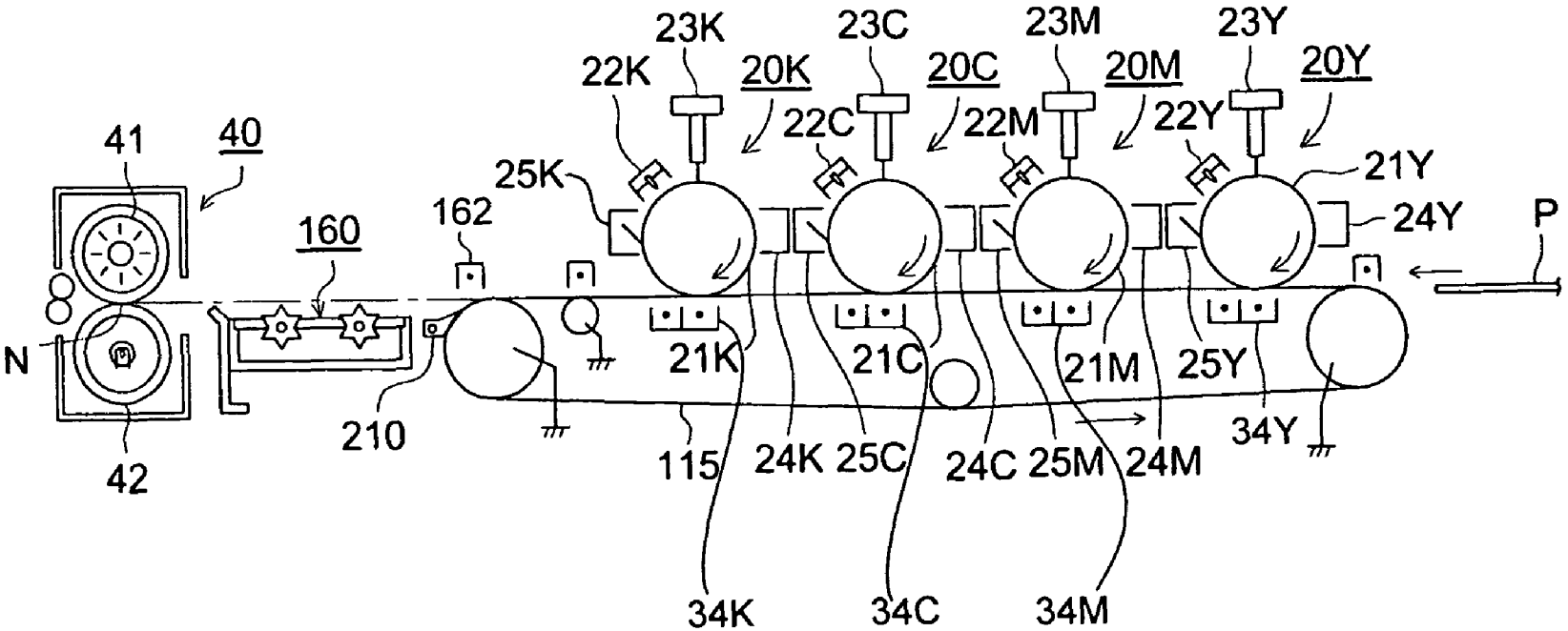
FIG. 4 is a cross-sectional construction diagram of another image forming apparatus of the invention.

FIG. 4 is a cross-sectional construction diagram of another example of an image forming apparatus of the invention. FIG. 4 shows an image forming apparatus that performs direct transfer onto a recording material on a transfer belt. The image forming procedure in FIG. 4 is almost the same as that in FIGS. 1 to 3, except that transfer is performed directly on the recording material instead of an intermediate transfer member.

The image forming apparatus, in FIG. 4, that performs direct transfer onto the recording material on the transfer belt will be described. FIG. 4 shows an example of color image forming by a tandem color image forming apparatus in which four photoreceptors are disposed in parallel and toner images in four colors of yellow (Y), magenta (M), cyan (C), and black (K) are sequentially transferred.

In FIG. 4, there are provided image forming units 20Y (20M, 20C, and 20K), for Y, M, C, and K, that are comprised of photoreceptor drums 21Y (21M, 21C, and 21K), scorotron chargers (charging device) 22Y (22M, 22C, and 22K), exposure optical systems (exposure devices), developing devices 24Y (24M, 24C, and 24K), and cleaning devices 25Y (25M, 25C, and 25K). Respective toner images formed by the image forming units of Y, M, C, and K are sequentially transferred by transfer devices 34Y (34M, 34C, and 34K) with a synchronized feeding of a recording material (recording sheet P) to be formed into a superimposed color toner image.

The recording sheet is conveyed by conveyor belt 115, and separated from the conveyor belt by neutralizing operation of paper sheet separating AC neutralizer 162 serving as a recording material separating device and by separating claw 210 that is a separating member arranged with a predetermined gap from the conveyor section 160.

Further, the recording sheet P is passed through the conveyor section 160, thereafter, conveyed to fixing device 40 that is comprised of heat roller 41 and pressure roller 42, sandwiched by nip section N formed by the heat roller 41 and the pressure roller 42, then the superimposed toner image is fixed on the recording sheet P by applied heat and pressure, and thereafter the recording sheet P is ejected outside the apparatus.

EXAMPLE

The invention will be described in detail with Examples. In the description "part" represents "weight part".

Preparation of Photoreceptor Group 1

<Under Coat Layer, UCL)

The following liquid coating composition was prepared and coated on a cleaned cylindrical aluminum base member with a diameter of 30 mm and surface roughness Rz of 1.0 μm, by an immersion coating method, to form an under coat layer.

Under Coat Layer Composition A

| Under coat layer composition A | |
|---|---|
| Organic segment composition A (Vinyl polymer having a hindered amine group and silyl group) | 100 part |
| Methyltrimethoxysilane | 70 part |
| Dimethyltrimethoxysilane | 30 part |
| Minute particles (Anatase type titanium oxide Al (primary particle diameter 35 nm; surface treated with methylhydrogen polysiloxane) | 100 parts |
| i-Butyl alcohol | 100 parts |
| Butylcellosolve | 75 parts |
| Di-i-propoxyethylacetoacetate aluminum | 10 parts |

The above components were mixed sufficiently, 30 parts of deionized water was dripped thereto under stirring, and was subjected to reaction at 60° C. for 4 hours. It was made cool to room temperature, then 10 parts of I-propyl alcohol solution of dioctyl tin dimaleate ester (solid content: 15%) was added and stirred to obtain coating composition for an under coat layer. The coating composition was applied on the cylindrical aluminum base member by means of circular amount regulation type coater, then heated at 120° C. for an hour, and thus, an under coat layer with a dry thickness of 6.5 μm was formed. The volume resistance of the intermediate layer after drying was $3\times10^{13}\Omega\cdot$cm under the measurement conditions described above.

| <Charge generating layer (CGL)> | |
|---|---|
| Oxy titanylphthalocyanine (G-1: a maximum peak of Bragg angle at 27.3° for a diffraction spectrum of characteristic X ray of CU-Kα) | 20 parts |
| Polyvinylbutyral (#6000-C, Denki Kagaku Kabushiki Kaisha) | 10 parts |
| 2-butanone | 700 parts |
| 4-Methoxy-4-methyl-2-pentanone | 300 parts |

The above composite was mixed, dispersed using a sand mill, and thus a charge generating layer liquid coating composition was prepared. This liquid coating composition was coated by an immersion coating method, and a charge generating layer with a dry layer thickness of 0.3 μm was formed on the under coat layer.

| <Charge transport layer (CTL)> | |
|---|---|
| Charge transport material (T-1: [4-(2,2,-diphenylvinyl)phenyl]-di-p-tolylamine | 75 parts |
| Polycarbonate resin (Iupiron Z300, manufactured by Mitsubishi Gas Chemical Campany Inc. | 100 parts |
| Irganox1010 manufactured by Nihon Chiba Geigy Co.) | 6 parts |
| Methylene chloride | 750 parts |

These were mixed, dissolved, and thus a liquid coating composition for a charge transport layer was prepared. This liquid coating composition was coated on the charge generating layer by a circular amount control type coating method, dried at 105° C. for 70 minutes, and a charge transport layer of a dry thickness of 12 μm was formed, and thus, photoreceptor Group 1 (4 photoreceptors produced in the same manner for tandem use).

Preparation of Anatase Type Titanium Oxide A1

To a solution in which 4 parts of methylhydrogen-polysiloxane was dissolved in 100 parts of alcohol/water (10/1) solvent 100 parts of anatase type titanium oxide pigment having primary particle size of 35 nm was mixed and dispersed in medium. After processing the medium dispersion over one day and night, anatase titanium oxide was taken from Medium dispersion and dried to obtain Titanium Oxide A1 having surface treated with hydrogenpolysiloxane and anatase degree 100%.

Preparation of anatase type titanium oxide A2

Anatase type Titanium Oxide A2 was obtained in the same was as Titanium Oxide A1, except that the amount of hydrogenpolysiloxane was increased to 5 parts in place of 4 parts.

Preparation of Anatase Type Titanium Oxide A3

Anatase type Titanium Oxide A3 was obtained in the same way as Titanium Oxide A1, except that the amount of hydrogenpolysiloxane was increased to 6 parts in place of 4 parts.

Preparation of Photoreceptor Groups 2-13

Photoreceptor groups 2-13 were prepared in the same way as Photoreceptor Group 1, except that surface roughness Rz of the aluminum base, organic segment composition, minute particles and dry thickness in the under coat layer, CGM, and CGL were modified as shown in Table 1.

Under coat layer B was provided in the same way as Under coat layer B except that Organic segment composition A was replaced by Organic segment composition B, as follows.

| Under coat layer composition B | |
|---|---|
| Organic segment composition B (Vinyl polymer having a hindered amine group and silyl group) | 100 part |
| Methyltrimethoxysilane | 70 part |
| Dimethyltrimethoxysilane | 30 part |
| Minute particles (Anatase type titanium oxide Al (primary particle diameter 35 nm; surface treated with methylhydrogen polysiloxane) | 100 parts |
| i-Butyl alcohol | 100 parts |
| Butylcellosolve | 75 parts |
| Di-i-propoxyethylacetoacetate aluminum | 10 parts |

Evaluation 1: Measurement of Coefficient α of Under Coat Layer of Photoreceptor Groups 1-13

Measurement of Contact Potential Difference and Plotting of Work Function

Samples for measurements were prepared by spin coating a under coating layer coating composition on each of electrodes composed of palladium (Pd), indium tin oxide (ITO), nickel-chromium alloy (Ni—Cr), titanium (Ti), aluminum (Al), aluminum-chromium alloy (Al—Cr), etc., followed by drying. The contact potential difference of each sample was measured using the Kelvin method under ambient atmosphere. The work function $\phi_{UCL}$ of the under coat layer thus obtained was plotted versus the corresponding work function $\phi_M$ of sample electrode measured without applying under coat layer. FIG. 5(*a*) shows plotting of work function of under coat layer of photoreceptor group 1. Measured result of coefficient α in Formula (a) for the photoreceptor groups 1-13 as well as surface roughness of aluminum base and composition of under coat layer, CGL and CTL are shown in Table 1.

TABLE 1

| | | Inter Layer | | | | CTL | | |
|---|---|---|---|---|---|---|---|---|
| Drum No. | Roughness of aluminum surface (Rz: μm) | Organic Segment | Minute Particle | Dry Thickness (μm) | CGL CGM | CTM | Dry Thickness (μm) | α in Formula (a) |
| 1 | 1.0 | A | A1 | 10 | G-1 | T-1 | 12 | 0.66 |
| 2 | 1.0 | A | A1 | 6.5 | G-1 | T-1 | 12 | 0.66 |
| 3 | 1.0 | B | A1 | 15 | G-1 | T-1 | 12 | 0.51 |
| 4 | 1.0 | A | A1 | 10 | G-1 | T-1 | 15 | 0.66 |
| 5 | 1.0 | A | A1 | 10 | G-1 | T-1 | 8 | 0.66 |
| 6 | 1.0 | A | A1 | 10 | G-1 | T-1 | 5 | 0.66 |
| 7 | 0.5 | A | A1 | 17 | G-1 | T-1 | 12 | 0.66 |
| 8 | 1.0 | A | A1 | 5 | G-1 | T-1 | 12 | 0.66 |
| 9 | 2.5 | A | A1 | 10 | G-1 | T-1 | 17 | 0.66 |
| 10 | 1.0 | A | A1 | 10 | G-1 | T-1 | 4 | 0.66 |
| 11 | 1.0 | A | A2 | 10 | G-2 | T-1 | 12 | 0.75 |
| 12 | 1.0 | A | A3 | 10 | G-1 | T-1 | 12 | 0.82 |

In Table 1, G-1 and G-2 are pigments stated below.

G-1: Titanyl phthalocyanine pigments having a maximum peak of Bragg angle 20±0.2° for CU—Kα radiation at 27.2°.

G-2: hydroxygallium phthalocyanine pigments having diffraction peaks of Bragg angle (2θ±0.2°) for a diffraction spectrum of characteristic X ray of CU—Kα at least at positions of 7.5°, 9.9°, 12.5°, 16.3°, 18.6°, 25.1°, and 28.1°.

Evaluation 2: Image Evaluation

The respective photoreceptor groups were mounted in a combination shown in Table 1 on a 1200 dpi digital color printer (exposure light wavelength 650 nm) based on the image forming apparatus shown in FIG. 1, and monochrome images and color images, in which both characters and halftones are present in a pixel ratio of 8%, were continuously printed on 50,000 A4 size sheets at a normal temperature and humidity (20° C. and RH 50%). Taking the printing ratio of monochrome printing to color printing with a tandem type color image forming apparatus into account, the ratio of the number of monochrome images to that of color images in printing was set to a ratio of 9 sheets of monochrome images to 1 sheet of color image, namely 9:1. During printing, printing was suspended when necessary for the following evaluations. The evaluation items and criteria are described below. Evaluation results are shown in Table 2. Thickness reduction of a photoreceptor foe monochrome image formation after 150,000 sheets printing was about 6.5 μm for each photoreceptor.

Evaluation Items and Criteria for Evaluation

"Dot Reproducibility of Monochrome Image"

Reproducibility of dots forming a black image was observed with a 100 times magnifier and evaluated. The dot reproducibility was evaluated with black images at the start of printing (S), after printing 50,000 sheets (50,000), and after printing 150,000 sheets (150,000).

A: Dot images are produced with increase or decrease of less than 30% in area compared with the exposure spot area, wherein the respective dot images are reproduced uncombined. (Good)

B: Dot images are produced with increase or decrease ranging from 30 to 60% in area compared with the exposure spot area, wherein the respective dot images are reproduced uncombined. (Practical level)

C: Dot images are produced with increase or decrease exceeding 60% in area compared with the exposure spot area, wherein the respective dot images are partially lost or connected. (Impractical level)

"Dot Reproducibility of Color Image"

Reproducibility of dots forming a color image was observed with a 100 times magnifier and evaluated. The dot reproducibility was evaluated with color images at the start of printing (S), after printing 50,000 sheets (50,000), and after printing 150,000 sheets (150,000).

A: A color image is reproduced with little unevenness between the respective dots of Bk, Y, M, and C (The difference between the area of the largest dot and the area of the smallest dot is smaller than 30% for each color.), and the color balance of the color image is excellent. (Good)

B: A color image is reproduced with unevenness between the respective dots of Bk, Y, M, and C, wherein the difference between the area of the largest dot and the area of the smallest dot ranging from 30 to 60% for each color, and the color balance of the color image is maintained.

(Practical Level)

C: A color image is reproduced with a significant unevenness between the respective dots of Bk, Y, M, and C (The difference between the area of the largest dot and the area of the smallest dot is larger than 60% for each color.), and the color balance of the color image is lost.

(Impractical Level)

"Periodic Image Defects"

Occurrence of image defects (such as black spots (including color spots), white blanks, or line-shape image defects), which correspond with the cycle of the photoreceptors were evaluated, using a monochrome image and a color image after printing 150,000 sheets.

Evaluation criteria are as follows.

A: Almost no apparent periodic image defects are observed. (less than 4 spots/A4 size sheet for black spots, density not greater than 0.02 for line shapes: Good)

B: Occurrence of apparent periodic image defects is within a practical range (4 to 10 spots/A4 size sheet for black spots, density ranging from 0.03 to 0.04 for line shapes: Practical level)

C: Apparent periodic image defects occurred in a range requiring reexamination about practicality. (11 to 20 spots/A4 size sheet for black spots, density ranging from 0.05 to 0.06 for line shapes: Requiring reexamination of practicability)

D: Many apparent periodic defects occurred. (more than 20 spots/A4 size sheet for black spots, density of 0.07 or higher for line shapes: Impractical level)

"Sharpness"

Sharpness of image was evaluated for the resolution of a monochrome image and a color image after printing 50,000 sheets with the criteria below.

A: Resolution of a line image equal to or higher than 16 lines/mm is achieved. (Excellent)

B: Resolution of a line image in the range from 10 to 15 lines/mm is achieved. (Practical level)

C: Resolution of a line image equal to or lower than 9 lines/mm is achieved. (Improper as a high resolution image)

"Tonal Gradation"

The evaluation conditions were changed into an environment with an ordinary temperature and humidity (20° C. and RH 60%); an original image having 60 tonal steps from a white image to a black solid image was copied; and then tonal gradation was evaluated. The evaluation was carried out by visual evaluation, with enough daylight, of images having tonal steps, and by the total number of steps of meaningful total steps.

A: more than 40 tonal steps (Good)

B: 21 to 40 tonal steps (Practical)

C: 11 to 20 tonal steps (Requiring reexamination of practicability: Practical for images in which total resolution is not significant)

D: less than 11 tonal steps. (Impractical)

Electric Potential Characteristic of Photoreceptor

As the electric potential characteristic of a photoreceptor, residual electric potentials (Vr) from the starting time to the time of printing 150,000 sheets were measured, and the variation width (AVr) was computed.

Other Evaluation Conditions

Charging conditions of photoreceptor: Electric potential at a non-image section was detected by an electric potential sensor to allow feedback control, setting the target potential to −800 V.

Image-wise exposure: Semiconductor laser (wavelength: 650 nm)

Image-wise exposure conditions: Semiconductor laser,

Exposure spot area: $3.54\times10^{-10}$ $m^2$, 1200 dpi

Neutralizing Conditions

Regarding neutralizing conditions before charging, an LED light (of a light amount value equal to or greater than three times a light amount required to reach the electric potential at the exposure section) with a wavelength of 680 nm was projected. A value of the surface electric potential after neutralization was measured as a residual electric potential.

Developing conditions: Reverse development was performed with the developing agent described below.

Developing agent 1Bk: A toner was prepared with colored particles (100 weight parts/volume average=5.2 μm/carbon black as a colored pigment) added with 0.5 weight parts of hydrophobic silica (hydrophobicity=75/number average primary particle diameter=12 nm) and 0.25 weight parts of 0.05 μm titanium oxide, and 45 μm ferrite carrier which is resin coated (in a mixture ratio of toner to carrier of 1/10 in weight ratio).

Developing agent 1Y: A developing agent which was prepared in the same way as the developing agent 1Bk except that CI pigment yellow 185 was used instead of carbon black as a colored pigment of toner was used.

Developing agent 1M: A developing agent which was prepared in the same way as the developing agent 1Bk except that CI pigment red 122 was used instead of carbon black as a colored pigment of toner was used.

Developing agent 1C: A developing agent which was prepared in the same way as the developing agent 1Bk except that CI Pigment Blue 15:3 was used instead of carbon black as a colored pigment of toner was used.

TABLE 2

| Drum | Dot reproduction in monochrome image | | | Dot reproduction in Dolor image | | | Periodic image | Grada- | Sharpness | | Residual Potential |
|---|---|---|---|---|---|---|---|---|---|---|---|
| No. | S | 50,000 | 150,000 | S | 50,000 | 150,000 | defect | tion | Mono-chrome | Color | (ΔVr) |
| 1 | A | A | A | A | B | B | A | A | A | A | 34 |
| 2 | A | A | A | A | B | B | A | A | A | A | 37 |
| 3 | A | A | A | A | A | B | A | A | A | A | 45 |
| 4 | A | B | B | B | B | B | A | B | A | B | 37 |

TABLE 2-continued

| Drum No. | Dot reproduction in monochrome image S | 50,000 | 150,000 | Dot reproduction in Dolor image S | 50,000 | 150,000 | Periodic image defect | Grada-tion | Sharpness Mono-chrome | Color | Residual Potential (ΔVr) |
|---|---|---|---|---|---|---|---|---|---|---|---|
| 5 | A | A | B | B | B | B | A | A | A | A | 35 |
| 6 | B | B | B | B | B | B | C | A | A | B | 28 |
| 7 | B | D | D | D | D | D | B | B | B | D | 70 |
| 8 | B | B | D | B | D | D | D | B | B | B | 29 |
| 9 | B | D | D | D | D | D | B | B | D | D | 72 |
| 10 | B | D | D | D | D | D | D | D | B | B | 24 |
| 11 | A | A | B | B | B | B | B | B | A | B | 46 |
| 12 | B | B | D | B | B | D | B | B | D | D | 124 |

Result in Table 2 shows that photoreceptor Groups 1 to 6 and 11 are good in dot reproduction, consequently good in gradation and sharpness, and occurrence of periodic image defect and increase of residual potential are minimized. Photoreceptor Groups 7 having under coat layer of 17 μm shows marked deterioration in dot reproduction of monochrome and color image, as well as increase of residual potential and lowering of sharpness of color image. Photoreceptor Groups 8 having under coat layer of 8 μm shows deterioration of reproduction of monochrome and color image and lowering of sharpness. Photoreceptor Groups 10 having CTL of 4 μm shows reproduction of monochrome and color image, occurrence of periodic image defect and lowering of sharpness. Photoreceptor Groups 10 having a of 0.82 shows increase of residual potential, gradual decrease of dot reproduction of monochrome and color image and lowering of sharpness.

<Evaluation 3: Image Evaluation>

The photoreceptor Groups 1 to 6, and 11 were used for evaluation, wherein the image-wise exposure conditions in Evaluation 2 were changed as follows.

Image-wise exposure conditions: exposure spot area:

$9.00\times10^{-11}$ $m^2$,2400 dpi

Evaluation Result

Even under the exposure condition of 2400 dpi, the respective evaluation items for the photoreceptor Groups 1 to 6, and 11 showed almost the same evaluation results as those in the case of the exposure condition of 1200 dpi.

<Evaluation 4: Image Evaluation>

The photoreceptor Groups 1 to 6 and 11 were used for evaluation, under the same conditions as those in Evaluation 2 except that the charging condition of photoreceptors used in Evaluation 2 was changed as below. Table 3 shows the evaluation results.

Charging conditions of photoreceptor: The electric potential at the non-image section was detected by an electric potential sensor, allowing feedback control, and the target potential was set to −400 V.

TABLE 3

| Drum No. | Dot reproduction in monochrome image Initial stage | 50,000 | 150,000 | Dot reproduction in Dolor image Initial Stage | 50,000 | 150,000 | Periodic image defect | Grad-ation | Sharpness Mono-chrome | Color | Residual Potential (ΔVr) |
|---|---|---|---|---|---|---|---|---|---|---|---|
| 1 | A | A | A | A | A | A | A | A | A | A | 21 |
| 2 | A | A | A | A | A | A | A | A | A | A | 25 |
| 3 | A | A | A | A | A | A | A | A | A | A | 18 |
| 4 | A | A | A | B | B | B | A | B | A | B | 24 |
| 5 | A | A | A | A | B | B | B | A | A | A | 24 |
| 6 | A | A | A | B | B | B | B | A | A | A | 20 |
| 11 | A | A | A | A | B | B | B | A | A | B | 35 |

Table 3 shows that, with a target electric potential set to −400 V as a charging condition, the photoreceptor Groups 1 to 6 and 11 have improved effects on periodic image defects, sharpness, and tonal resolution, which are further improved compared with the case of the target potential being −800 V in Evaluation 2.

<Evaluation 5: Image Evaluation>

The photoreceptor Groups 1 to 6 and 11 were used for evaluation, under the same conditions as those in Evaluation 4 except that the charging condition of photoreceptors used in Evaluation 4 was changed as below.

Charging condition of photoreceptor: Electric potential at the non-image section was detected by an electric potential sensor, allowing feedback control, and evaluation was performed at 2 levels of target electric potential being −200 V and −300 V.

Evaluation Results

In the case of setting the charging electric potential to −200 V and −300 V, the photoreceptor Groups 1 to 6 and 11 showed almost the same effects as those in the case of the target electric potential being −400 V in Evaluation 4.

The invention claimed is:

1. A photoreceptor for electrophotography, comprising:

an under coat layer having a thickness of 6 to 15 μm, the undercoat layer containing a binder resin and particles of surface treated titanium oxide containing niobium element; and a charge generation layer and a charge transport layer provided on a substrate, and a thickness of the charge transport layer being 5-15 μm;

wherein the under coat layer has a gradient of a straight line represented by α, α being not more than 0.8, wherein α is linearly approximated by the following formula (a):

$$\phi_{UCL}=\alpha\cdot\phi_M+\beta \quad \text{(a) } (\alpha,\beta\text{:constant}),$$

wherein $\phi_{UCL}$ represents a work function of the under coat layer and $\phi_M$ represents a work function of a conductive electrode material, both work functions obtained by measuring a contact potential difference of conductive electrode materials.

2. The photoreceptor of claim 1, wherein the surface treated titanium oxide is an N-type semiconductive material.

3. The photoreceptor of claim 2, wherein the surface treated titanium oxide is surface treated anatase titanium oxide.

4. The photoreceptor of claim 3, wherein the surface treated anatase titanium oxide particles have a number average diameter of primary particle of from 5 to 400 nm.

5. The photoreceptor of claim 3, wherein the surface treated anatase titanium oxide particles are anatase titanium oxide particles subjected to a surface treatment by a reactive organic silicon compound.

6. The photoreceptor of claim 5, wherein the reactive organic silicon compound is methylhydrogenpolysiloxane.

7. The photoreceptor of claim 3, wherein the surface treated anatase titanium oxide particles are anatase titanium oxide particles subjected to surface treatment by an organic silicon compound having a fluorine atom.

8. The photoreceptor of claim 3, wherein the surface of surface treated anatase titanium oxide particles is subjected to alumina, silica, or zirconia treatment.

9. The photoreceptor of claim 1, wherein the under coat layer comprises a resin having an organic segment component and an inorganic segment component.

10. The photoreceptor of claim 9, wherein the organic segment component is a silyl modified vinyl polymer comprising hindered amine or hindered phenol group.

11. The photoreceptor of claim 1, wherein α is from 0.3 to 0.8.

12. The photoreceptor of claim 1, wherein the photoreceptor comprises an organic photosensitive layer.

13. The photoreceptor of claim 1, wherein the photoreceptor comprises an organic charge generation layer.

14. The photoreceptor of claim 1, wherein the photoreceptor comprises an organic charge transport layer.

15. A toner image forming method employing the photoreceptor of claim 1 and comprising steps of:

imagewise exposing the photoreceptor digitally under condition of 1,200 dpi or more.

16. The method of claim 15, wherein charging potential of the electrically charging the organic photoreceptor is 200 to 400 volts.

17. The method of claim 15, which comprises steps of:

electrically charging an organic photoreceptor;

imagewise exposing the photoreceptor digitally with resolution of 1,200 dpi or more so that a latent image is formed on the photoreceptor;

developing the latent image with toner so that a toner image is formed on the photoreceptor.

18. A toner image forming apparatus comprising the photoreceptor of claim 1, and an imagewise exposing device to expose the photoreceptor digitally under condition of 1,200 dpi or more.

19. The photoreceptor of claim 1, wherein the under coat layer comprises 10-10,000 parts by weight of surface treated titanium oxide particles based on 100 parts by weight of the binder resin.

20. The photoreceptor of claim 1, wherein volume resistivity of the under coat layer is not less than $1\times10^8\Omega\cdot$cm.

21. The photoreceptor of claim 20, wherein volume resistivity of the under coat layer is $1\times10^8$ to $1\times10^{15}\Omega\cdot$cm.

22. The photoreceptor of claim 20, wherein volume resistivity of the under coat layer is $1\times10^9$ to $1\times10^{14}\Omega\cdot$cm.

23. The photoreceptor of claim 1, wherein the under coat layer comprises a binder resin containing an organic segment component, an inorganic segment component, and an antioxidizing component.

24. The photoreceptor of claim 23, wherein the antioxidizing component is a hindered amine or hindered phenol group.

25. The photoreceptor of claim 1, wherein the niobium element is present in an amount of 100 ppm to 2.0 percent by weight of the surface treated anatase titanium oxide particles.

26. The photoreceptor of claim 25, wherein the niobium element is in an amount of 300 ppm to 1.8 percent by weight of the surface treated anatase titanium oxide particles.

27. A photoreceptor for electrophotography, comprising:

an under coat layer having a thickness of 6-15 μm; and a charge generation layer and a charge transport layer provided on a substrate, a thickness of the charge transport layer being 5-15 μm, wherein the under coat layer contains a binder resin and metal oxide particles of surface treated titanium oxide containing niobium element.

28. The photoreceptor for electrophotography of claim 27, wherein an amount of the metal oxide particles is 50 to 1,000 parts by weight with respect to 100 parts by weight of the binder resin.

* * * * *